US006702062B2

(12) United States Patent
Kusabiraki et al.

(10) Patent No.: US 6,702,062 B2
(45) Date of Patent: Mar. 9, 2004

(54) EXHAUST SYSTEM FOR AUTOMOBILE ENGINE

(75) Inventors: Yoshiharu Kusabiraki, Aki-gun (JP); Ryotaro Nishida, Aki-gun (JP); Akinori Wakasa, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 10/098,622

(22) Filed: Mar. 18, 2002

(65) Prior Publication Data

US 2002/0166720 A1 Nov. 14, 2002

(30) Foreign Application Priority Data

Mar. 19, 2001 (JP) ..... 2001-078162

(51) Int. Cl.[7] ..... F01N 7/10

(52) U.S. Cl. ..... 181/240; 181/212; 181/228; 181/238; 60/272; 60/323

(58) Field of Search ..... 181/227, 228, 181/232, 240, 258, 212, 238, 261, 268, 272, 275; 60/272, 323, 305, 313

(56) References Cited

U.S. PATENT DOCUMENTS 5,726,397 A * 3/1998 Mukai et al. ..... 181/232

FOREIGN PATENT DOCUMENTS

| | | |
|---|---|---|
| JP | 4-91224 U | 8/1982 |
| JP | 63-54816 U | 4/1988 |
| JP | 10-252458 A | 9/1998 |
| JP | 11-303630 A | 11/1999 |

* cited by examiner

*Primary Examiner*—Robert Nappi
*Assistant Examiner*—Renata McCloud
(74) *Attorney, Agent, or Firm*—Nixon Peabody LLP; Donald R. Studebaker

(57) ABSTRACT

An exhaust system having an exhaust manifold that comprises a plurality of single-shell discrete exhaust pipes connected to an engine, a double-shell collective chambered pipe joined to the discrete exhaust pipes and comprising an internal pipe shell into which exhaust gas streams passing through the discrete exhaust pipes are introduced and merge together and an external pipe shell surrounding the internal pipe shell, and a spherical joint connecting the collective chambered pipe to the exhaust pipe. The discrete exhaust pipe has a bent portion and a straight portion continuously extending from the bent portion to the collective chambered pipe. The bent portions of the respective discrete exhaust pipes are oriented toward a center of a straight row of cylinders so as to lay the straight portions of the discrete exhaust pipes nearly parallel to one another.

12 Claims, 22 Drawing Sheets

EXHAUST SYSTEM FOR AUTOMOBILE ENGINE

BACKGROUND OF THE INVENTION

1. Field of the Invention

The present invention relates to an exhaust system for an internal combustion engine that is equipped in an automotive vehicle, and, more particular, to an engine exhaust system that has a plurality of discrete exhaust pipes branching off from an exhaust pipe and connected to a cylinder head and an exhaust pipe.

2. Description of Related Art

Typically, a catalytic converter, that is disposed in an engine exhaust line, is desirably activated in a short period of time after a start of an engine in order to improve a catalytic conversion efficiency. In recent years, for quick activation of the catalytic converter, there has been proposed a heat insulated exhaust manifold operative to hold a temperature of an exhaust gas discharged from the engine as high as possible and then to direct the exhaust gas to the catalytic converter. Such heat insulated exhaust manifolds are known from, for example, Japanese Unexamined Patent Publication No. 11-303630 and Japanese Unexamined Utility Model Publication No. 63-54816.

The prior art heat insulated exhaust manifold disclosed in Japanese Unexamined Patent Publication No. 11-303630 comprises four double-walled discrete exhaust pipes connected at upstream ends to a cylinder head and joined at downstream ends to a double-walled chamber for collecting exhaust gases passing through the discrete exhaust pipes. This double-walled structure is somewhat troublesome to manufacture the heat insulated exhaust manifold and exerts various restraints on the configuration of the heat insulated exhaust manifold. Specifically, a bent portion of the heat insulated exhaust manifold must be large in bending radius and long in length. In other words, due to layout requirements of the engine in an engine compartment, a straight portion of the double-walled heat insulated exhaust manifold must be short in length. As a result, the double-walled heat insulated exhaust manifold provides an exhaust gas with a high resistance, so as to have an adverse influence on the output property of the engine.

The prior art heat insulated exhaust manifold disclosed in Japanese Unexamined Utility Model No. 63-54816 comprises single wall discrete exhaust pipes and a double-walled chamber for collecting exhaust gases passing through the discrete exhaust pipes. This heat insulated exhaust manifold having the double-walled chamber is focused only on lowering noises of an exhaust gas flow passing therethrough and preventing pulsations of the exhaust gas from propagating into exhaust pipes before and after the double-walled chamber.

While the heat insulated exhaust manifold is advantageous to protecting parts around the exhaust manifold from heat damage and activating quickly a catalytic converter in an exhaust line, the heat insulated exhaust manifold is apt to be heated by a hot exhaust gas passing therethrough and therefore to be filled with heat. Accordingly, the heat insulated exhaust manifold is necessary to have a heat releasing mechanism. If releasing heat through a fitting flange of the heat insulated exhaust manifold through which the heat insulated exhaust manifold is fitted to the cylinder head, a rubber gasket (a sealing member) between the cylinder head and the cylinder cover and supplementary devices around the engine are apt to encounter heat deterioration.

There has been proposed in Japanese Unexamined Utility Model 4-91224 an exhaust manifold having a generally U-shaped fitting bracket. Specifically, the exhaust manifold for an in-line four cylinder engine comprises four discrete exhaust pipes made of steel pipes that are connected to a cylinder block through a fitting flange and a collective chambered pipe made of a casting pipe, that are divided by a casting partition into two collective chambers and connected to downstream ends of the discrete exhaust pipes so that exhaust gas streams passing through the discrete exhaust pipes merge together in the collective chambered pipe. The exhaust manifold is fitted to the engine by securing the U-shaped fitting bracket bolted to the collective chambered pipe to a fitting boss of a cylinder head of the engine. As the partition is also made of a casting as well as the collective chambered pipe and is thick, it does not make noises resulting from engine vibrations.

When using a steel pipe in place of the casting pipe for the collective chambered pipe in order to reduce the weight of the collective chambered pipe, the partition makes vibrations resulting from engine vibrations, so as to make noises. In addition, as the U-shaped fitting bracket is fitted to the collective chambered pipe by fastening bolts into bolt holes formed in bosses of the collective chambered pipe and also to the boss of the cylinder block, it is hard to absorb thermal expansion of the exhaust manifold due to a hot exhaust gas.

SUMMARY OF THE INVENTION

It is an object of the present invention to provide an exhaust system having a heat insulated exhaust manifold that can provide an engine with an improved output characteristic and gain improved heat insulation effectiveness.

It is another object of the present invention to provide an exhaust system having a heat insulated exhaust manifold is adapted to radiate heat from a space formed between a fitting flange of an exhaust manifold and a cylinder head and has a heat guide member operative to conduct heat toward far from the engine so as thereby to prevent a sealing member disposed between a cylinder head and a cylinder cover and supplementary devices around the engine from encountering heat deterioration.

It is still another object of the present invention to provide an exhaust system having an exhaust manifold that is improved in structural rigidity by securing a partition of the collective chambered pipe to a welded joint structure of high rigidity through which a plurality of discrete exhaust pipes are joined to a collective chambered pipe.

It is still a further object of the present invention to provide an exhaust system having an exhaust manifold that is further improved in structural rigidity by supporting the exhaust manifold to the engine through a supporting bracket that is attached at or in close proximity to a welded joint structure between discrete exhaust pipes and a collective chambered pipe.

The exhaust manifold according to an embodiment of the present invention comprises a plurality of single-shell discrete exhaust pipes connected to exhaust ports formed in the cylinder head, respectively, a collective chambered pipe joined to the single-shell discrete exhaust pipes that is made up of an internal pipe shell into which exhaust gas streams passing through the single-shell discrete exhaust pipes are introduced and merge together and an external pipe shell surrounding the internal pipe shell, and spherical joint means connecting the collective chambered pipe to the exhaust pipe disposed downstream the collective chambered pipe and supported to the vehicle body. Each of the single-shell discrete exhaust pipes has a bent portion and a straight portion continuously extending from the bent portion to the collective chambered pipe. The bent portions of the single-shell discrete exhaust pipes are oriented toward a center of a straight row of cylinders so as to lay the straight portions of the single-shell discrete exhaust pipes nearly parallel to one another, and the single-shell discrete exhaust pipes and the collective exhaust pipe are joined to each other at least partly at a height of a plane including the interface between the cylinder block and the cylinder head.

The exhaust manifold thus structured can be provided with a long straight path of exhaust gas by the straight portions of the single-shell discrete exhaust pipes and the collective chambered pipe that is straight, so as thereby to reduce the resistance of exhaust gas. This results in helping the engine to raise output. In addition, the collective chambered pipe can be provided with high heat insulation effectiveness by having a length as long as possible. This results in quick activation of the catalytic converter installed in the exhaust system. The discrete exhaust pipe that is made of a single shell is easily bent.

The spherical joint between the collective chambered pipe and the exhaust pipe allows relative movement between the exhaust manifold and the exhaust pipe. This eases undesirable transmission of rolling vibrations of the engine to the exhaust pipe through the exhaust manifold.

The engine is preferably of a rear exhaust type that draws in intake air at the front side thereof and discharges exhaust gases at the rear side thereof. Owing to this engine position, the exhaust manifold is protected from exposure to the wind of speeding vehicle. This improves the high heat insulation effectiveness of the intake manifold. In addition, this makes it possible to shorten the length of the exhaust path from the upstream ends of the single-shell discrete exhaust pipes to the catalytic converter.

The exhaust manifold may be provided with a fitting flange connected to the upstream ends of the single-shell discrete exhaust pipes. The bolt holes formed in the fitting flange are arranged alternately along opposite upper and under sides of the fitting flange in a direction of the straight row of cylinders. At least one of the bolt holes that is in close proximity to the single-shell discrete exhaust pipes, specifically the bolt hole in close proximity to the single-shell discrete exhaust pipes, is located above a horizontal plane including centers of openings of the upstream ends of the single-shell discrete exhaust pipes. This arrangement of the bolt holes provides the straight portion of each of the single-shell discrete exhaust pipes with a long path of exhaust gas a sufficient space for installation work using, for example, an impact wrench. In this connection, if the bolt hole in close proximity to the single-shell discrete exhaust pipes is located below horizontal plane including centers of openings of the upstream ends of the single-shell discrete exhaust pipes, the bent portions of the single-shell discrete exhaust pipes must be long in consideration of a space for installation work using an impact wrench and the straight portions of the single-shell discrete exhaust pipes must be correspondingly shortened.

The exhaust manifold may include a catalytic converter disposed downstream from the collective chambered pipe and under the vehicle body in close proximity to the collective chambered pipe. This arrangement of the catalytic converter can get rid of the necessity of installing a catalytic converter immediately after an exhaust manifold like an exhaust system of a front exhaust engine and, as a result, can be located as close to the collective chambered pipe as possible so as to be quickly activated due to a hot exhaust gas.

The exhaust pipe may be of a double shell type that is made up of internal and external pipe shells. The double shell exhaust pipe provides improvement of hear insulation effectiveness in cooperation with the double shell collective chambered pipe.

The collective chambered pipe may be divided into two collective chambers, the first collective chamber and a second collective chamber located closer to the engine than the first collective chamber, by the partition. Exhaust gas streams passing through the single-shell discrete exhaust pipes, respectively, for the cylinders at opposite ends of the straight row of cylinders enter into the first collective chamber and merge together. Exhaust gas streams passing through the single-shell discrete exhaust pipes and for the remaining cylinders enter into the second collective chamber and merge together. The internal pipe shell of the collective chambered pipe shell extends straight in a direction of exhaust gas streams and gradually decreases in a cross-sectional area from the upstream end to the downstream end.

The collective chambered pipe having the second collective chamber located closer to the first collective chamber makes it possible to employ the single-shell discrete exhaust pipes that have the bent portions shortened in length. The use of the partition installed in the internal chambered pipe shell makes the collective chambered pipe compact as compared with using two independent internal pipe shells for dividing the interior of the collective chambered pipe into the first and second collective chambers and makes a surface area of the collective chambered pipe small. This structure of the collective chambered pipe reduces a thermal capacity, and hence radiation of heat, of the collective chambered pipe and, in addition, gradually constricts an exhaust gas stream. In the case of installing the exhaust system to, in particular, a four-cylinder engine, a compact 4-2-1 type exhaust system can be realized. The 4-2-1 type exhaust system is referred to the exhaust system, in which four exhaust gas streams passing through the four discrete exhaust pipes merge together into two exhaust gas streams and thereafter into one exhaust gas stream, is hardly affected by back pressure and exhaust gas pulsations.

The exhaust manifold may further comprise an insulation shell made up of two mating shell halves, i.e. the upper insulation shell half and the under insulation shell half, that covers the exhaust manifold, in particular at least the single-shell discrete exhaust pipes that are apt to radiate a comparatively large amount of heat as compared with the double-shell collective chambered pipe. This prevents the exhaust manifold from losing heat to the atmosphere and, therefore, protects peripheral devices and parts from heat damage. Further, this provides the exhaust manifold with high heat insulation effectiveness.

The exhaust manifold may be provided with spacer means installed in a space between the internal and external pipe shells and of the double-shell collective chambered pipe. This spacer means separates the internal pipe shell from the external pipe shell mechanically so as to allow longitudinal expansion of the internal pipe shell due to a difference of thermal expansion between the internal and external pipe shells. Further, the spacer means has supporting rigidity greater at a specified extent of its lower portion than at the remaining portion. The difference in supporting rigidity can be realized by differing at least one of material, width in the lengthwise direction of the internal or external pipe, thickness, and mesh size for the lower portion from that for the remaining portion. The exhaust manifold with the spacer means installed in the collective chambered pipe prevents the internal pipe shell, in particular the lower portion of the internal pipe shell, from causing mechanical interference with the external pipe shell due to vibrations.

According to another embodiment of the present invention, the exhaust manifold has a collective chambered pipe divided into a first collective chamber into which exhaust gas streams passing through single-shell discrete exhaust pipes for cylinders not sequentially adjoin in firing order and a second collective chambers into which exhaust gas streams passing through single-shell discrete exhaust pipes for the remaining cylinders not sequentially adjoin in firing order by a partition so that the first collective chamber is positioned farther away from the engine than the second collective chamber. The supporting bracket is secured to the exhaust manifold at a welded joint structure between the discrete exhaust pipes and the collective chambered pipe, or in close proximity to the welded joint structure at a side of the second collective chamber, so as to extend toward the engine. The partition at its top end is preferably secured to the welded joint structure that is high in structural rigidity. The partition and the supporting bracket are separately are separately located far away from each other. This structure of the collective chambered pipe prevents transmission of engine vibrations to the partition and, accordingly, from producing noises resulting from vibrations.

The supporting bracket may comprise a bracket arm and a flange tongue connected as one right-angle piece by a curved portion. The supporting bracket at the flange tongue is secured to the collective chambered pipe at the welded joint structure or in close proximity to the welded joint structure at a side of the second collective chamber. This right angle configuration of the supporting bracket is helpful in easing thermal expansion of the exhaust manifold and in absorption of engine vibrations. In addition, The collective chambered pipe comprises the internal and external pipe shells joined and welded at their upstream ends only so as to form a space between the internal and external pipe shells and the supporting bracket is secured to the outer pipe shell in a position downstream from the welded joint structure where the external pipe shell is separated from the internal pipe shell. This joint structure of the collective chambered pipe is advantageous, on one hand, to preventing transmission of engine vibrations to the partition in the collective chambered pipe and, on the other hand, to improving structural rigidity and weld strength in addition to realizing improved heat insulation effectiveness of the collective chambered pipe that is advantageous to quick activation of the catalytic converter.

The single-shell discrete exhaust pipe may have a downstream end portion that comprises a rounded shell portion configured and a right-angle shell portion. The four discrete exhaust pipes thus configured and connected to the collective chambered pipe form four quadrant downstream end portions arranged so as to meet in configuration the internal pipe shell of the collective chambered pipe and form a cruciform space among the right-angle shell portions in which a cruciform reinforcement is welded to the right-angle portions of the discrete exhaust pipes. The cruciform reinforcement may be made up of an upper extension of the partition of the collective chambered pipe 28 and a reinforcement strip assembled crosswise. This cruciform reinforcement welded to the discrete exhaust pipes avoids a presence of a joint gap among the discrete exhaust pipes, so as to increase structural rigidity and weld strength of the welded joint structure and, in addition, prevent the discrete exhaust pipes from making mechanical interference with one another.

According to another embodiment, the exhaust manifold covered by the insulation shell made up of the upper and under insulation shell halves configured so as to leave a specified length of heat radiating clearance or space between the insulation shell and the fitting flange. The exhaust manifold thus structured may be provided with a heat guide member that conducts and releases exhaust heat from the heat radiating space toward far from the engine. The exhaust manifold provided with the heat guide member is advantageous to preventing a sealing member disposed between the cylinder head and the cylinder cover and supplementary devices around the engine from encountering heat deterioration. The heat guide member may be formed integrally with or separately from a gasket through which the exhaust manifold 1 is installed to the cylinder head of the engine.

The insulation shell halves that are joined to one another so as to partly overlap along their lengthwise sides. The joint gap between the overlapped sides of the insulation shell halves is desirably as small as possible and, more desirably, smaller than the space distance of the heat radiation space as possible. The insulation shell thus structured is advantageous to, on one hand, preventing exhaust heat from escaping from the insulation shell through the joint gap and, on the other hand, radiating the exhaust heat into the atmosphere through the heat radiating space between the insulation shell and the fitting flange. In addition, the insulation shell thus structured enhances the heat releasing effect of the heat guide member. The exhaust manifold is suitably installed to a rear exhaust type in-line multiple cylinder engine installed in the transverse direction in the engine compartment. This engine arrangement is advantageous to protecting the engine and supplementary.

The insulation shell may be formed with a plurality of ribs or beads as reinforcement mean extending in the transverse direction thereof. The insulation shell formed with the ribs or beads is preferably installed to the exhaust manifold by fastening bolts through bolt holes formed in the ribs or beads. The exhaust manifold covered by the insulation shell thus installed improves structural rigidity of the exhaust manifold.

BRIEF DESCRIPTION OF THE DRAWINGS

The above and other objects and features of the present invention will be clearly understood from the following detailed description when read with reference to the accompanying drawings, wherein the same numeral numbers have been used to denote same or similar parts or mechanisms throughout the drawings and in which.

DETAILED DESCRIPTION OF THE PREFERRED EMBODIMENTS

Figure 1:
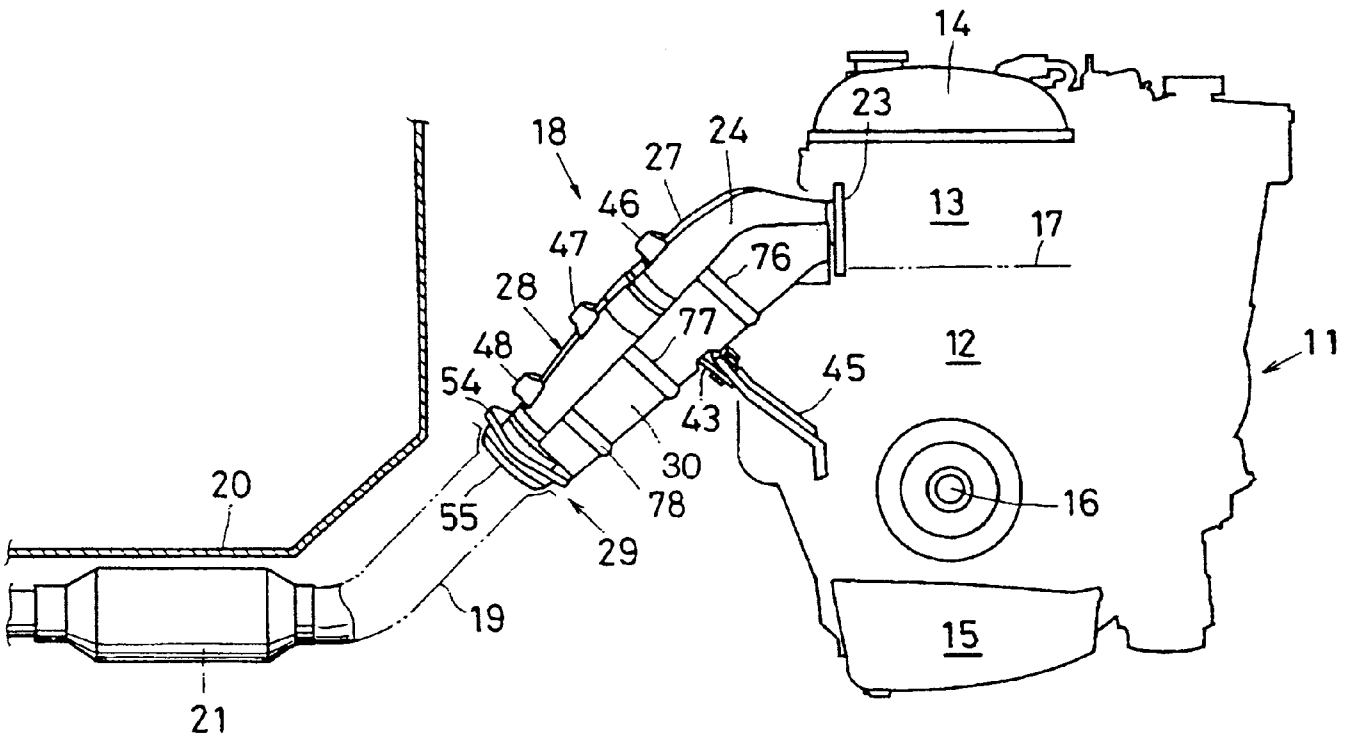
FIG. 1 is a side view of an exhaust system according to an embodiment of the present invention.

Referring to the drawings in detail and, in particular, to FIG. 1 showing a structure of an exhaust system for an automotive vehicle according to an embodiment of the present invention, an in-line four cylinder internal combustion engine (which is hereafter referred to as an engine for simplicity) 11 comprises a cylinder block 12 and a cylinder head 13 with a head cover 14 attached thereto. The engine 11 is provided with a crankshaft 16 mounted to the cylinder block 12 and an oil pun 15 below the cylinder block 12. Designated by a reference numeral 17 is an interface between the cylinder block 12 and the cylinder head 13. The engine 12 is provided with an intake system (not shown) directed to the front of the vehicle body and an exhaust manifold 18 directed to the back of the vehicle body (rear exhaust type engine) and is mounted in a transverse direction in an engine compartment (not shown). This arrangement of the exhaust manifold 18 is intended to prevent the exhaust manifold 18 from being exposed to the wind of the speeding vehicle so as thereby to prevent the exhaust gas from lowering its temperature. The exhaust system, that will be described in detail later, includes an exhaust manifold 18 comprising four, namely first to fourth, single-shell discrete exhaust pipes 24–27 and a double-shell collective chambered pipe 28. These first to fourth single-shell discrete exhaust pipes 24–27 are in communication with first to fourth cylinders (#1, #2, #3 and #4), respectively. The exhaust manifold 18 at its downstream end is connected to an exhaust pipe 19 that extends below a front floor panel 20 of the vehicle body and is equipped with a catalytic converter 21. The exhaust manifold 18 is provided with a fitting flange 23 and is bolted to the cylinder head 13 through a gasket 22 disposed between the fitting flange 23 and the cylinder head 13 (see FIGS. 2 and 3).

Figure 2:
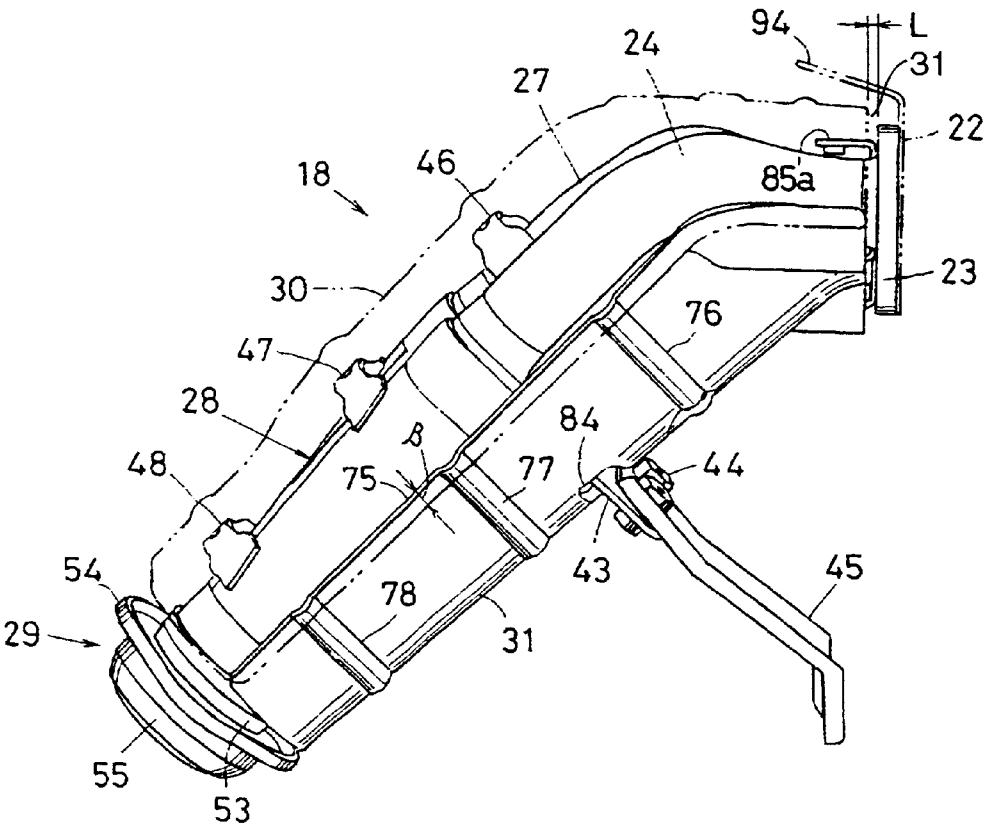
FIG. 2 is an enlarged view of an exhaust manifold of the exhaust system.
Figure 3:
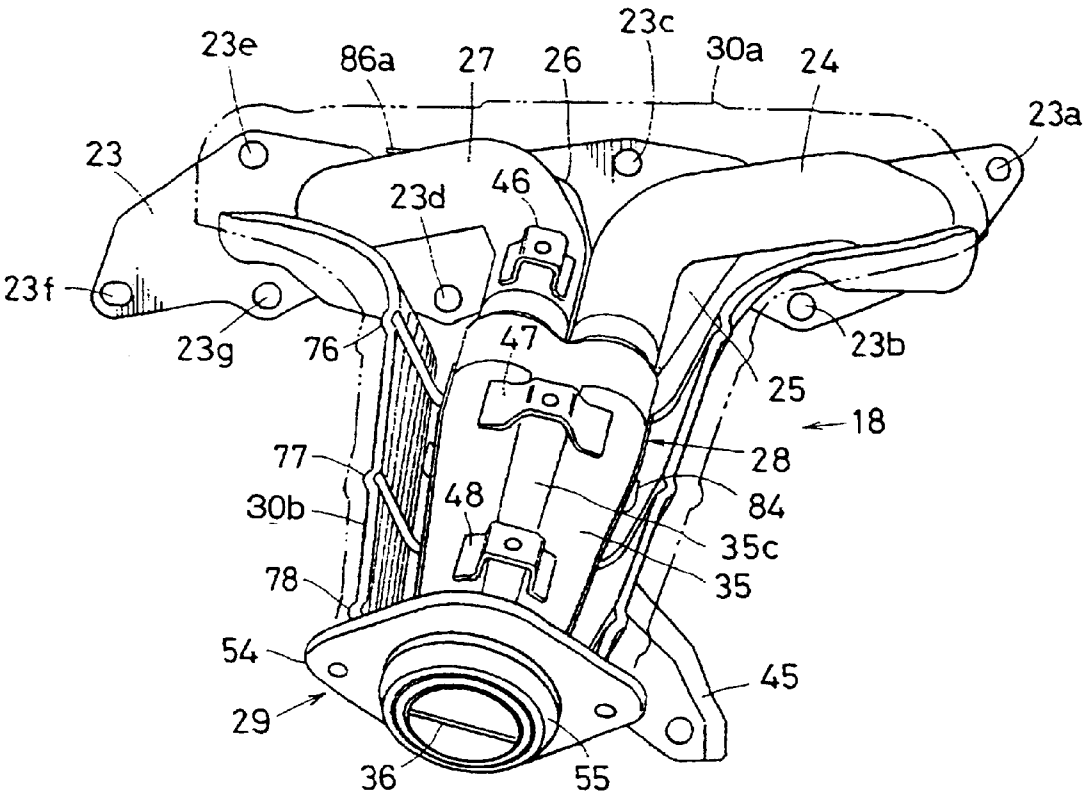
FIG. 3 is a rear view of the exhaust manifold.
Figure 4:
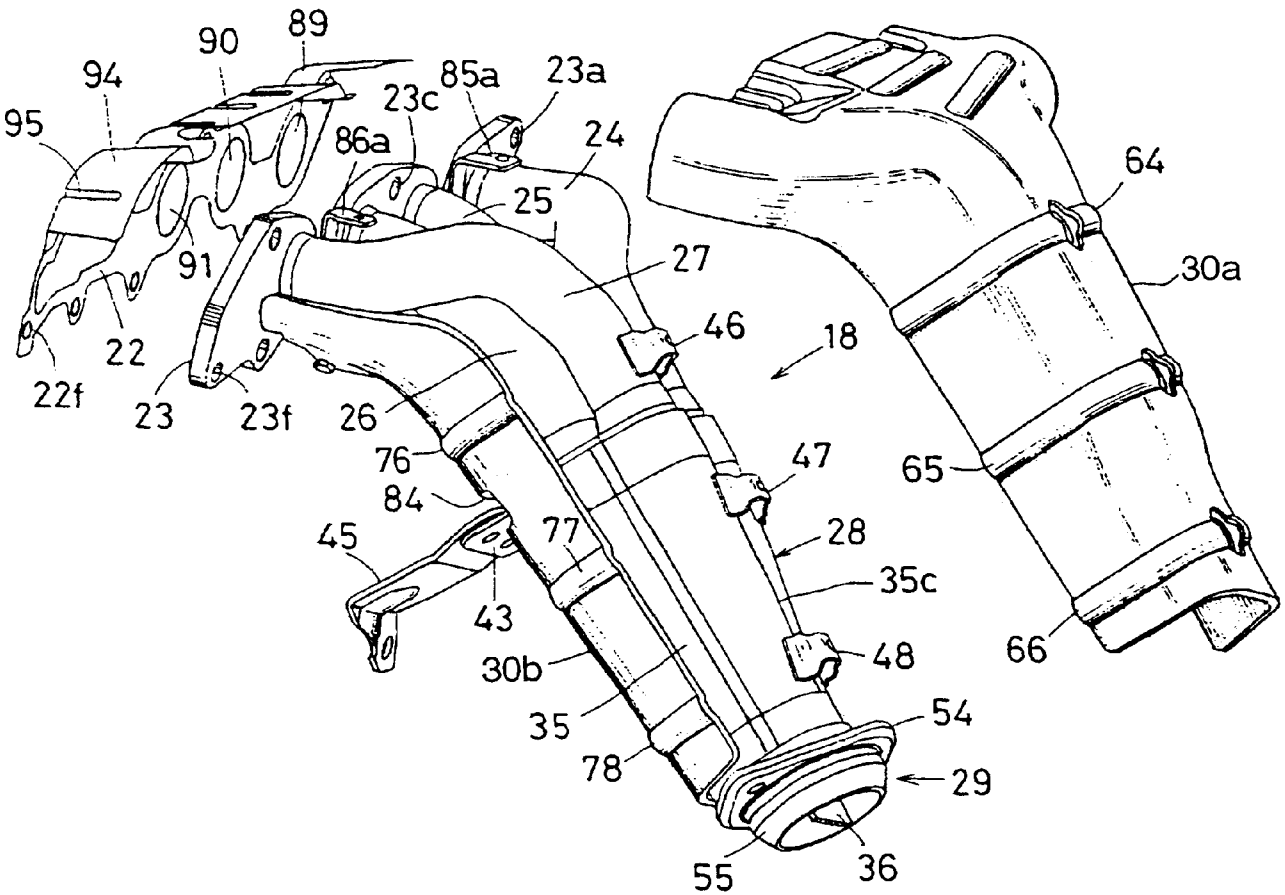
FIG. 4 is an exploded view of the exhaust manifold.

Referring to FIGS. 2 to 3 showing the exhaust manifold 18 in detail, the collective chambered pipe 28 is connected to downstream ends of the respective single-shell discrete exhaust pipes 24–27 so as to collect exhaust gases passing through the respective single-shell discrete exhaust pipes 24–27 therein. The collective chambered pipe 28 at its downstream side is provided with a spherical joint 29 (which will be described in connection with FIG. 12) through which the collective chambered pipe 28 is connected to the exhaust pipe 19 so as to restrain undesirable transmission of rolling vibrations of the engine 11 to the exhaust pipe 19 through the exhaust manifold 18. The exhaust manifold 18 is covered from the fitting flange 23 to the downstream end of the collective chambered pipe 28 by an insulation shell 30 made up of two mating shell halves, namely an upper insulation shell half 30*a* and an under insulation shell half 30*b*, for securely keeping an exhaust gas as high as possible and preventing heat damage to parts around the exhaust manifold 18. The catalytic converter 21 is disposed below the front floor panel 20 at a location downstream from and close to the collective chambered pipe 28. The insulation shell 30 may be made up of more than two parts.

Figure 5:
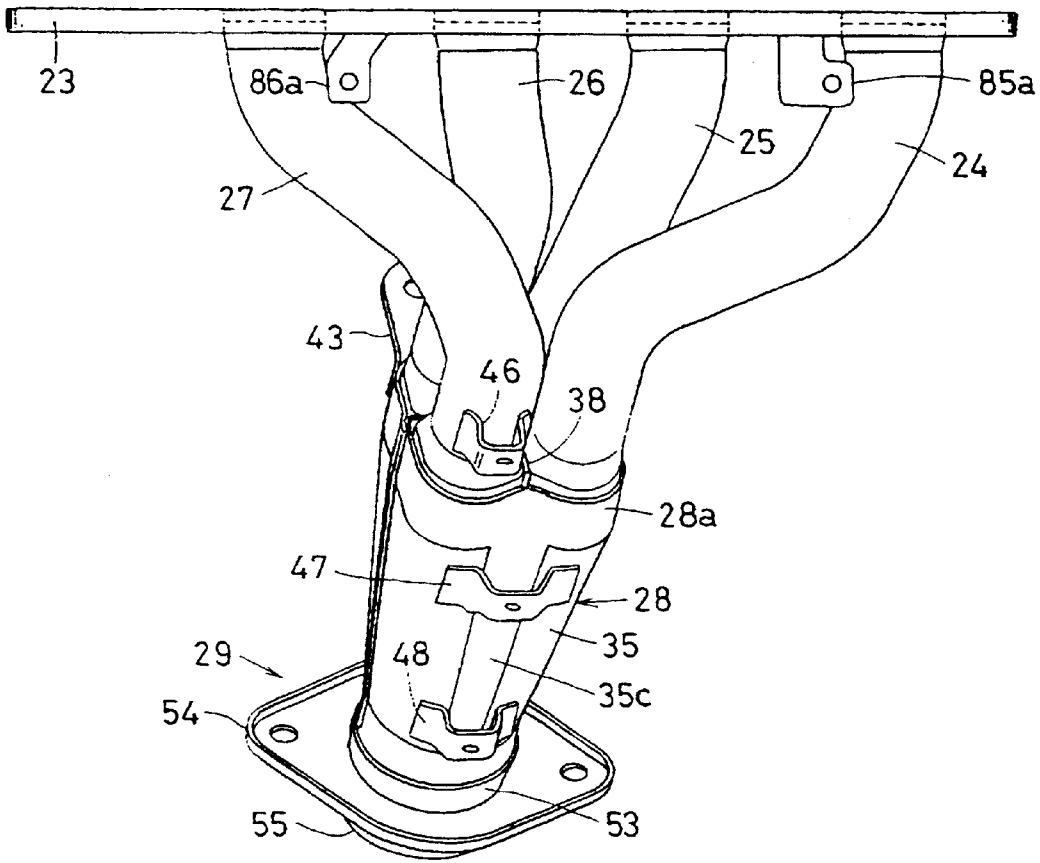
FIG. 5 is a plan view of the exhaust manifold with an insulation shell removed.
Figure 6:
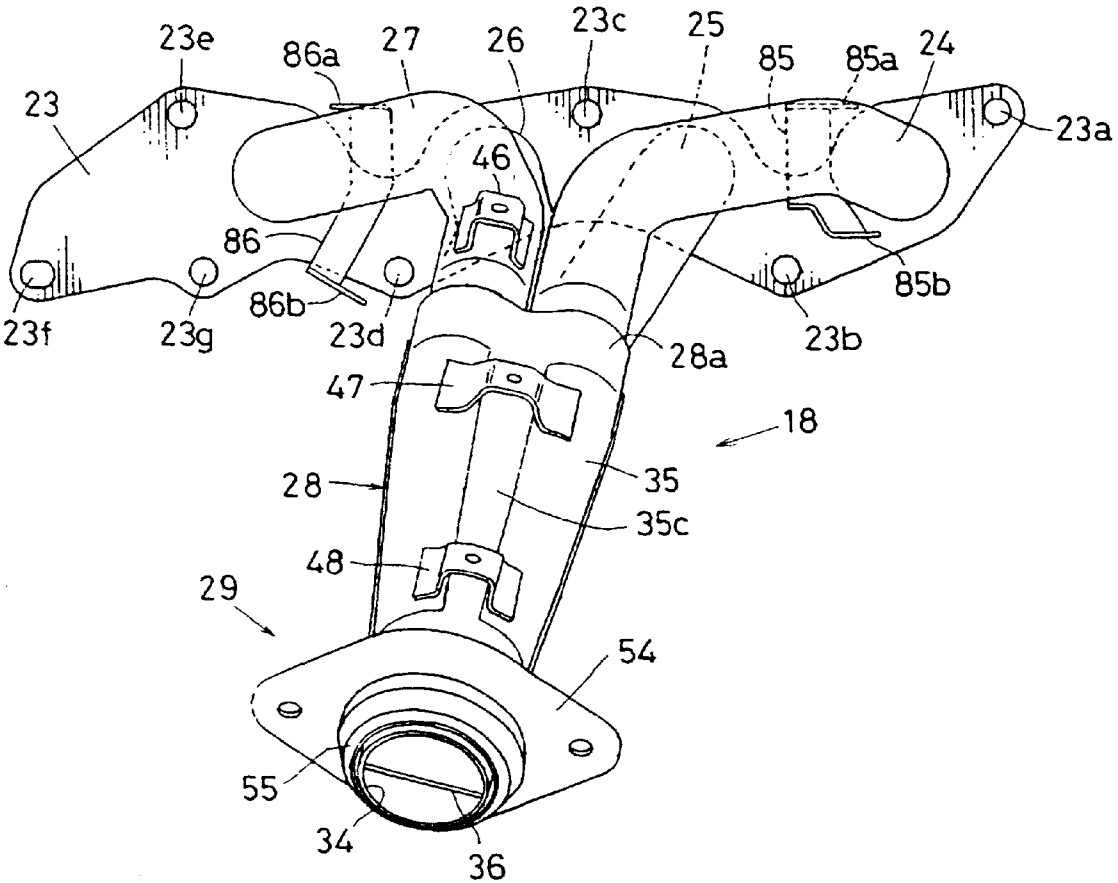
FIG. 6 is a front perspective view of the exhaust manifold with an insulation shell removed.
Figure 7:
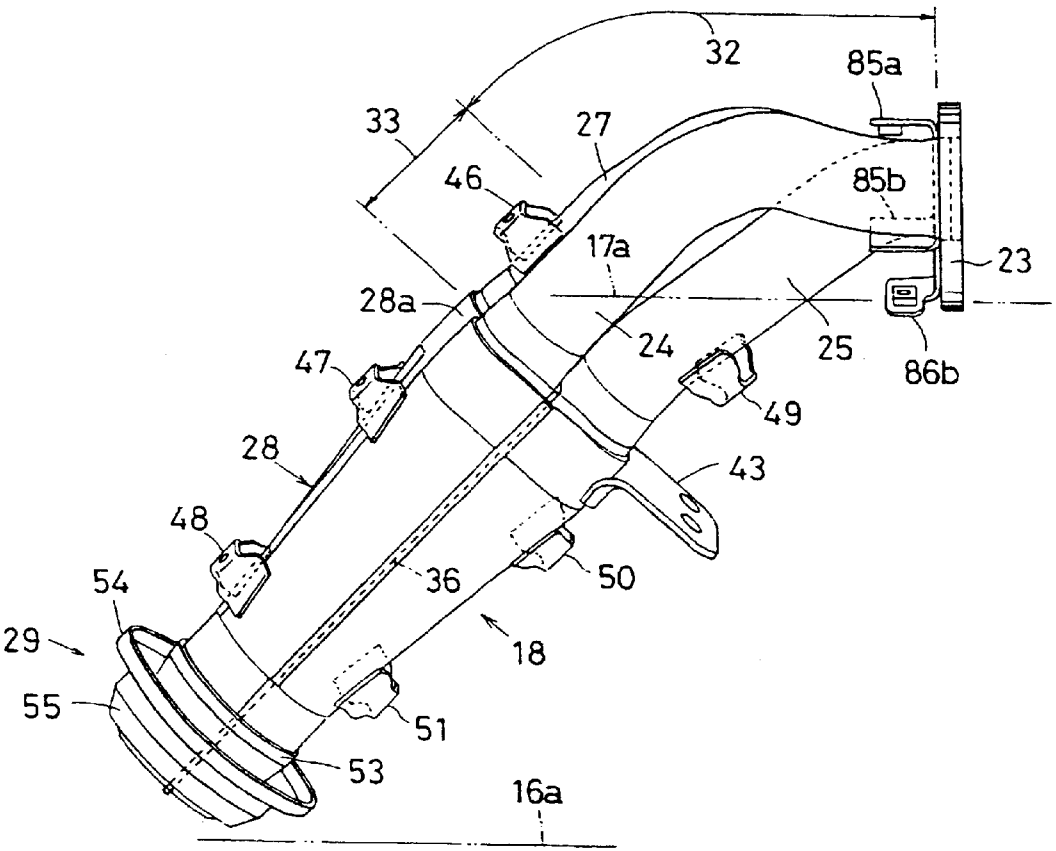
FIG. 7 is a side view of he exhaust manifold with an insulation shell removed.
Figure 9:
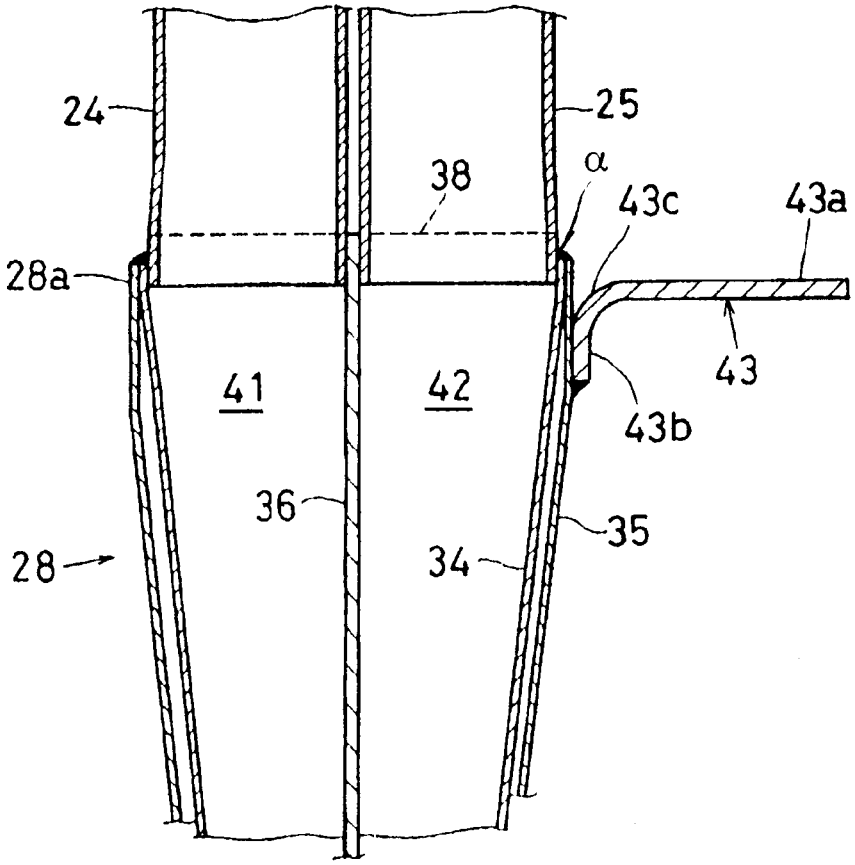
FIG. 9 is a longitudinal cross-sectional view of the exhaust manifold taken along line IX—IX of FIG. 8.

FIGS. 5 to 7 show the exhaust manifold 18 and, in particular, the single-shell discrete exhaust pipes 24–27 with the upper and under insulation shell halves 30*a* and 30*b* removed. These single-shell discrete exhaust pipes 24–27, each of which is made of a round steel pipe, are formed separately from one another in consideration of bending workability. As seen in FIG. 7, the single-shell discrete exhaust pipes 24–27 have bent portions 32 and straight portions 33, respectively, The bent portions 32 are located at their upstream ends in close proximity to the exhaust ports of the corresponding cylinders, respectively, and are directed spatially toward the middle of a straight row of the four cylinders so that center lines of the respective single-shell discrete exhaust pipes 24–27 are substantially parallel to one another. The straight portion 33 of each single-shell discrete exhaust pipe 24–27 extends from the bent portion 32 to the collective chambered pipe 28. In this instance, the first and fourth single-shell discrete exhaust pipes 24 and 27, that are for the foremost and rearmost or first and fourth cylinders (#1 and #4), are substantially the same in overall length. Similarly, the second and third single-shell discrete exhaust pipes 25 and 26, that are for two center, or second and third cylinders (#2 and #3) located between the first and fourth cylinders (#1 and #4), are substantially the same in overall length but shorter than the first and fourth single-shell discrete exhaust pipes 24 and 27. The straight portions 33 of the respective single-shell discrete exhaust pipes 24–27 and the collective chambered pipe 28 are in a straight line as one whole. As shown in FIG. 9, a welded joint structure 28*a* between each of the single-shell discrete exhaust pipe 24–27 and the collective chambered pipe 28 is at a height of a interface 17 between the cylinder block 12 and the cylinder head 13. More specifically, in this embodiment, the welded joint structure 28*a* inclines so as to intersects a horizontal plane 17*a* including the interface 17 between the cylinder block 12 and the cylinder head 13. Further, as shown in FIG. 7, the spherical joint 29 between the collective chambered pipe 28 and the exhaust pipe 19 is located closely to a horizontal plane 16*a* including an axis of rotation of the crankshaft 16.

Figure 10:
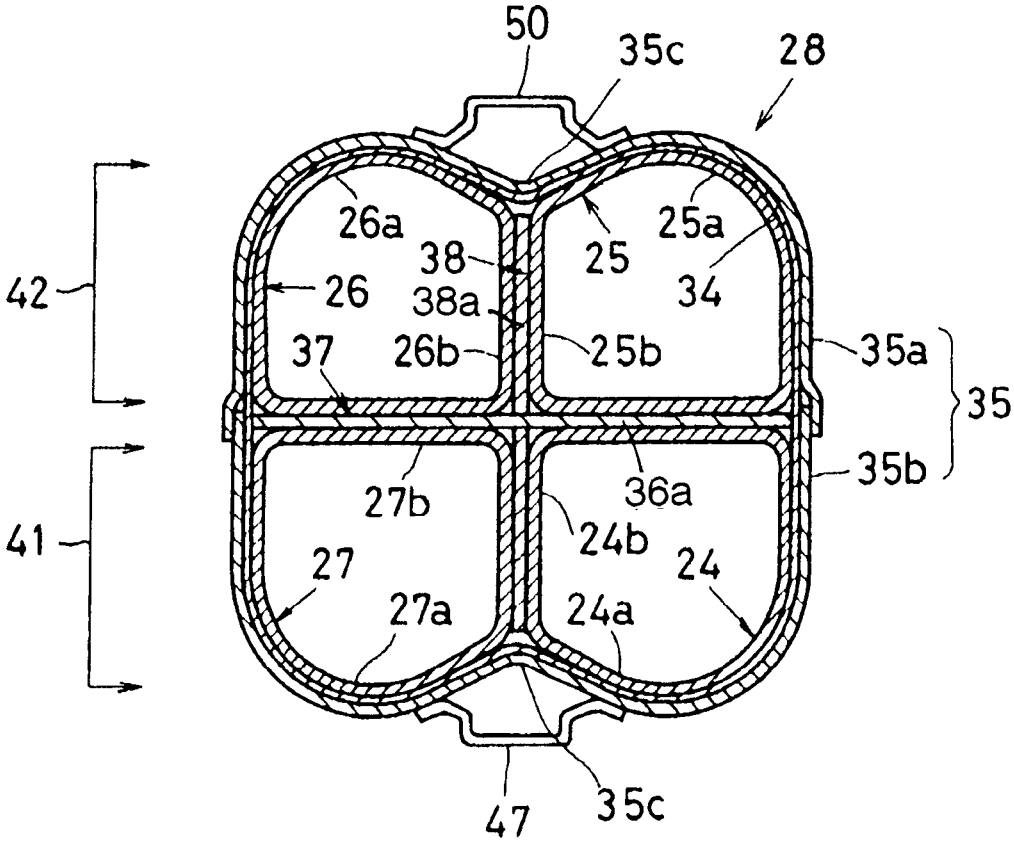
FIG. 10 is a transverse cross-sectional view of the exhaust manifold taken along line X—X of FIG. 8.
Figure 11:
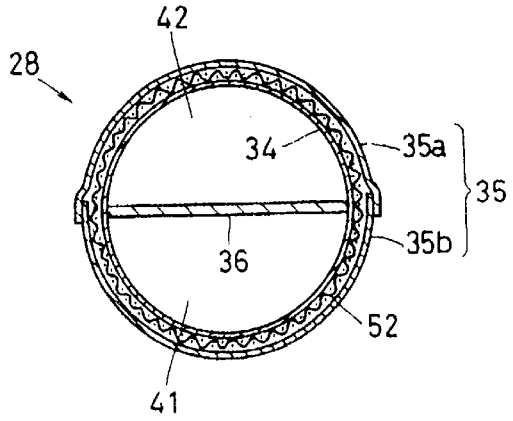
FIG. 11 is a transverse cross-sectional view of the exhaust manifold taken along line XI—XI of FIG. 8.

FIGS. 8 to 11 show partly the exhaust manifold 18 in detail. The collective chambered pipe 28 into which exhaust gases are collectively introduced through the single-shell discrete exhaust pipes 24–27 is of a double-shell type. Specifically, the collective chambered pipe 28, which is desirable to have a length as large as possible, comprises an internal pipe shell 34 through which an exhaust gas stream enters and an external pipe shell 35 surrounding the internal pipe shell 34 with a cylindrical space between the internal pipe shell 34. As shown in FIGS. 10 and 11, the external pipe shell 35 is made up two mating shell halves 35*a* and 35*b*. These pipe shells 34 and 35 are often constructed of heat-resisting cast iron and are welded at their upstream ends using MIG inert-gas arc welding or laser welding so as to form an upstream end of the collective chambered pipe 28. As shown in FIGS. 9 to 11, the collective chambered pipe 28 has a cross-section gradually reducing in area from the upstream end to the downstream end and has a partition 36 made of a heat-resisting iron which divides an upstream half portion of the interior of the collective chambered pipe 28 into two chambers, namely a first collective chamber 41 and a second collective chamber 42. The partition 36 is disposed in and welded to the internal pipe shell 34 so as to position the first collective chamber 41 farther away from the engine 11 than the second collective chamber 42. Specifically, the single-shell discrete exhaust pipes 24 and 27 for the first and fourth cylinders (#1 and #4) that do not sequentially adjoin in firing order are in communication with the first collective chamber 41. Similarly, the single-shell discrete exhaust pipes 25 and 26 for the second and cylinders (#2 and #3) that do not sequentially adjoin in firing order are in communication with the second collective chamber 42. Accordingly, exhaust gas streams passing through the first and forth exhaust pipes 24 and 27 merge together in the first collective chamber 41 and exhaust gas streams passing through the second and third single-shell discrete exhaust pipes 25 and 26 merge together in the second collective chamber 42. Further, the exhaust gas streams passing through the first and second collective chambers 41 and 42 merge together in the downstream half portion of the interior of the collective chambered pipe 28. The exhaust system thus constructed is what is called 4-2-1 type for joining exhaust four gas streams step by step into one exhaust gas stream. This 4-2-1 type exhaust system is hardly affected by back pressure and exhaust gas pulsations. In this instance, the firing order in the in-line four cylinder internal combustion engine 11 may be #1, #3, #4, #2 or #1, #2, #4, #3.

Referring to FIG. 10 showing the welded joint structure between the collective chambered pipe 28 and the single-shell discrete exhaust pipes 24–27 in detail, the single-shell discrete exhaust pipes 24–27 have downstream end portions, respectively, each of which comprises a rounded shell portion 24*a*–27*a* formed so as to meet partly the inner wall of the internal pipe shell 34 of the collective chambered pipe 28 and a right-angle shell portion 24*b*–27*b*. The first and forth exhaust pipes 24 and 27 are arranged so as to provide a cruciform space 37 between the adjacent right-angle shell portions 27*b*–27*b* in which a cruciform reinforcement 38 is welded, or otherwise fixed, to the lower ends of right-angle shell portions 27*b*–27*b* of the first and forth exhaust pipes 24 and 27. The cruciform reinforcement 38 is made up of an upper extension 36*a* of the partition 36 of the collective chambered pipe 28 and a reinforcement strip 38*a*. This cruciform arrangement of the first and forth exhaust pipes 24 and 27 that are welded to the cruciform reinforcement 38 avoids a presence of a joint gap among the first and forth exhaust pipes 24 and 27, so as to improve structural rigidity and weld strength of the welded joint structure.

In order to support the exhaust manifold 18 to the engine 11, there is provided a supporting bracket 43 such as shown in detail in FIG. 9. The supporting bracket 43 is welded, or otherwise fixedly attached, to the collective chambered pipe 28 at or in close proximity to the welded joint structure 28*a* between the collective chambered pipe 28 and the single-shell discrete exhaust pipes 24–27 on the side of the second collective chamber 42 so as to extend toward the engine 11. The supporting bracket 43 is fixedly connected to a bracket 45 secured to the cylinder block 12 of the engine 11 as shown in FIG. 1 by bolt and nut fastening means 44 (see FIG. 2). The supporting bracket 43 has a bracket arm 43*a* and a flange tongue 43*b* connected as one right-angle piece by a curved portion 43*c*. The flange tongue 43*b* is bent downward at an approximately right angle in this embodiment. In particular, the supporting bracket 43 at its lower end of the flange tongue 43*b* is welded to the collective chambered pipe 28 at the welded joint structure 28*a* where the internal pipe shell 34 and the external pipe shell 35 at their upstream ends are welded to each other. The right angle configuration of the supporting bracket 43 is helpful in easing thermal expansion of the exhaust manifold 18.

Figure 8:
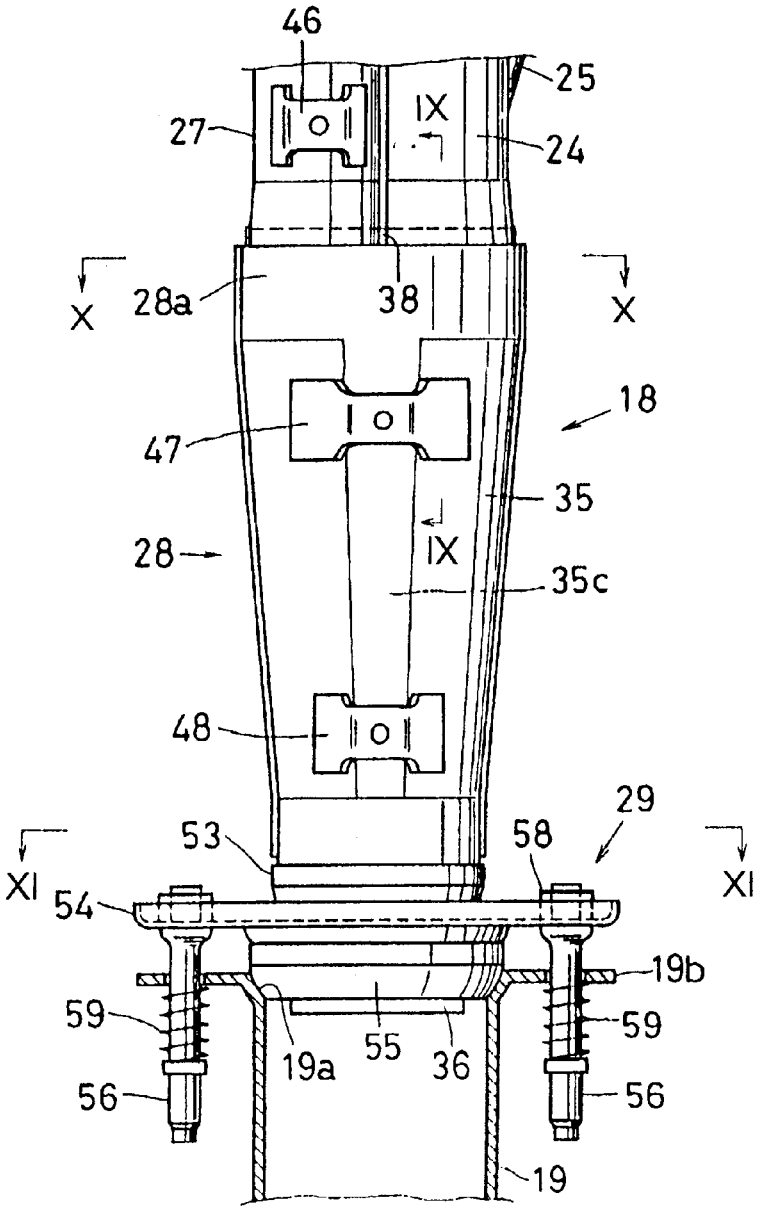
FIG. 8 is a front view of a collective chambered pipe of the exhaust manifold.

The exhaust manifold 18 is further provided with brackets 46–51 for securing the insulation shell 30, specifically the upper and under insulation shell halves 30*a* and 30*b* as shown in detail in FIGS. 7 and 8. One of these brackets 46–51, namely the bracket 46 in this embodiment, is welded, or otherwise fixedly attached, to the upper side of the straight portion 33 of the single-shell discrete exhaust pipe 27 and another one of these brackets 46–51, namely the bracket 49 in this embodiment, is welded, or otherwise fixedly attached, to the under side of the straight portion 33 of the single-shell discrete exhaust pipe 25. Two of the remaining brackets 47, 48, 50 and 51, namely the brackets 47 and 48 are welded, or otherwise fixedly attached, to the under side of the external pipe shell 35 of the collective chambered pipe 28 near opposite end portions so as to cross over an elongated recess 35*c*. Similarly, other two of the remaining brackets 47, 48, 50 and 51, namely the brackets 50 and 51 are welded, or otherwise fixedly attached, to the upper side of the external pipe shell 35 of the collective chambered pipe 28 near opposite end portions so as to cross over an elongated recess 35*c*. Each of the bracket 46–51 is provided with a nut (not shown) into which a fitting bolt is fastened so as to fix the insulation shell 30, namely the upper insulation shell half 30*a* and the under insulation shell half 30*b*, to the single-shell discrete exhaust pipes 25 and 27 and the external pipe shell 35 of the collective chambered pipe 28. This structure enables the use of small sized brackets 47, 48, 50 and 51, a compact external pipe shell 35 that is less bulgy, and fastening means, such as bolts and nuts, having an increased fastening length for fixedly attaching the insulation shell 30, i.e. the upper and under insulation shell halves 30*a* and 30*b*, to the exhaust manifold 18.

As was previously described, the exhaust manifold 18 is provided with the fitting flange 23 through which the exhaust manifold 18 is installed to the cylinder head 12 of the engine 11. As shown in detail in FIG. 6, the fitting flange 23 is formed with a plurality of bolt holes 23*a*–23*g* arranged alternately along opposite sides thereof in a direction of said straight row of cylinders. The bolt hole 23*c* at a location close to the single-shell discrete exhaust pipes 25 and 26 for the center cylinders (#2 and #3) is positioned above a straight row of the first to fourth cylinders (#1 to #4), more specifically above a horizontal plane including centers of end openings of the four single-shell discrete exhaust pipes 24–27, in consideration of providing the straight portion 33 of each of the single-shell discrete exhaust pipes 24–27 with a long length and forming a sufficient space for installation work using, for example, an impact wrench. One of the bolt holes 23*a* and 23*f* at opposite extreme ends of the fitting flange 23, namely the bolt hole 23*f*, is formed in the shape of oval in consideration of easy positional adjustment and installation of the fitting flange 23 to the cylinder head 12 of the engine 11. One or more of the remaining bolt holes may be of course formed in the shape of oval.

Referring to FIG. 11 showing a structure for supporting the internal pipe shell 34 in the collective chambered pipe 28, while the internal pipe shell 34 at its upstream end is welded to the external pipe shell 35 as shown in FIG. 9, the internal pipe shell 34 at its downstream end is mechanically separated from the external pipe shell 35 so as to be expandable in a lengthwise direction due to a difference of thermal expansion between the internal and external pipe shells 34 and 35. In order to support the internal pipe shell 34 to the external pipe shell 35 or vise versa, spacer means 52 made of, for example, a stainless wire mesh is installed in the cylindrical space formed between the internal and external pipe shells 34 and 35. In particular, the spacer means 52 is fitted in the external pipe shell 34 or on the internal pipe shell 35. The spacer means 52 may be a cylindrical spacer tube filling the cylindrical space or a plurality of annular spacer rings arranged with separations in the cylindrical space. The spacer means 52 is configured so as to have supporting rigidity greater at its lower portion on which the weight of the internal pipe shell 34 acts than at the remaining portion. This difference in supporting rigidity may be provided by differing at least one of material, width in the lengthwise direction, thickness, and mesh size for the lower portion from that for the remaining portion. While, in this embodiment shown in FIG. 11, the spacer means 52 is configured so as to lie entirely in the circumferential direction in the cylindrical space between the internal and eternal pipe shells 34 and 35, the spacer means 52 may be configured so a to lie partly or intermittently in the circumferential direction in the cylindrical space. Further, the spacer means may be a cylindrical member or may comprise a plurality of annular ring members arranged with separations in the lengthwise direction in the cylindrical space.

Figure 12:
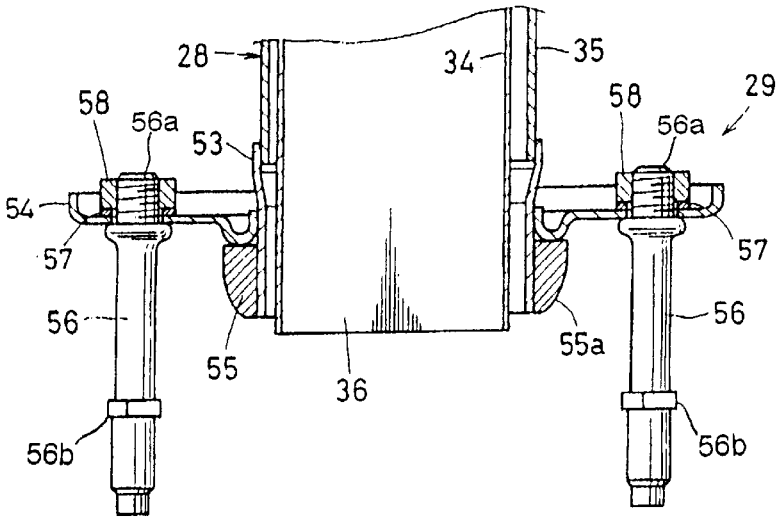
FIG. 12 is a longitudinal cross-sectional view of a spherical joint.
Figure 13:
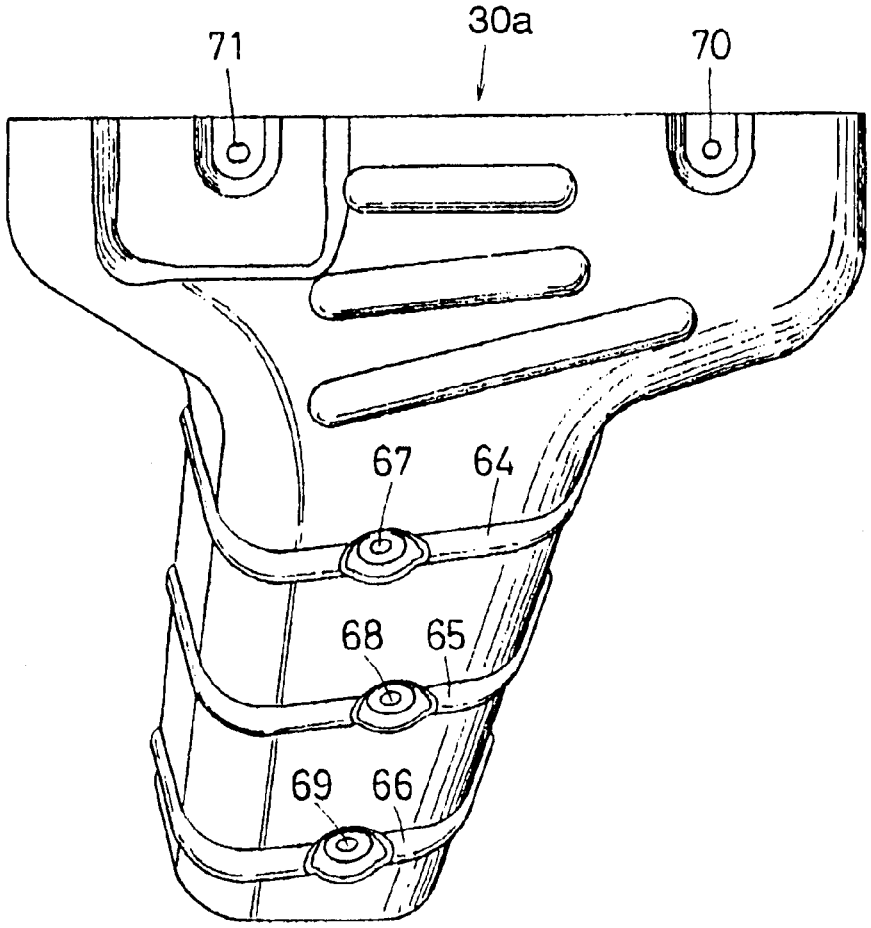
FIG. 13 is a plan view of an upper insulation shell half of the insulation shell.
Figure 14:
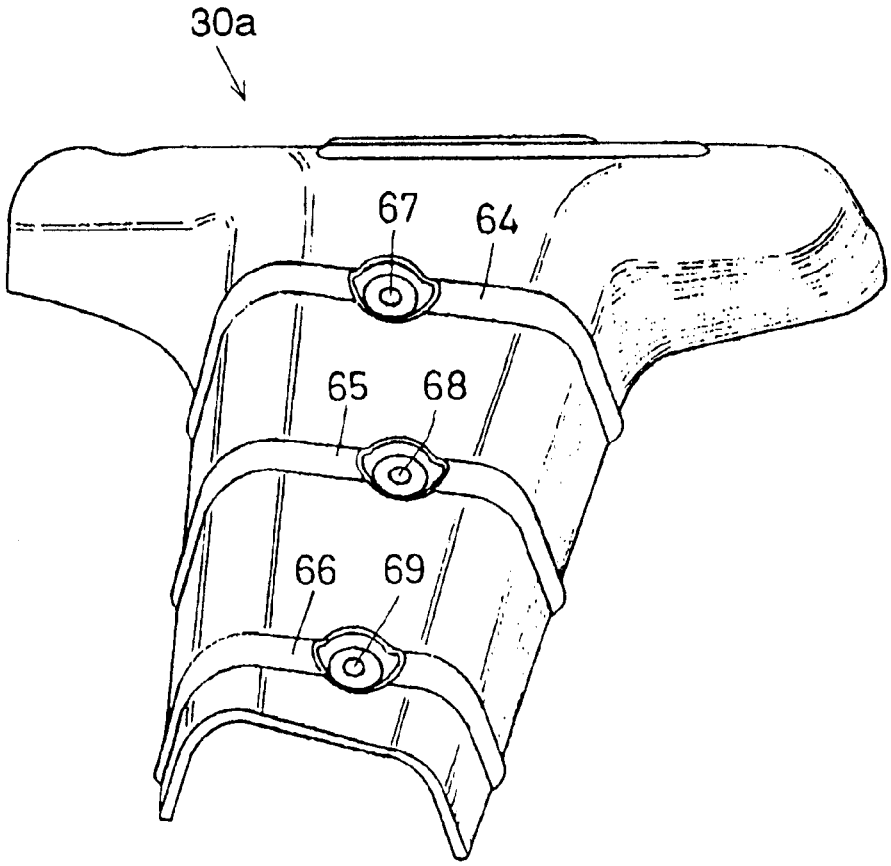
FIG. 14 is a front view of the upper insulation shell half of the insulation shell.
Figure 15:
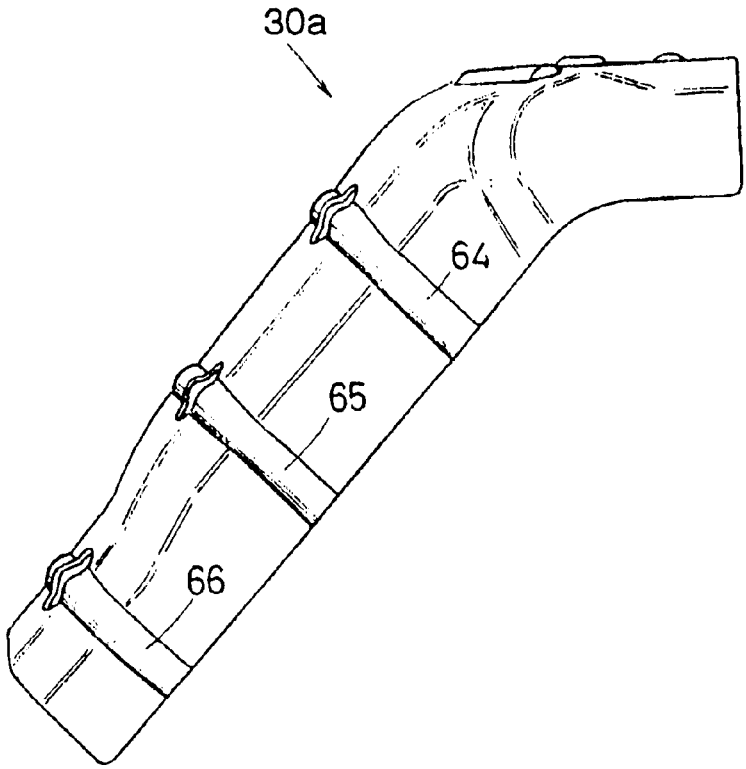
FIG. 15 is a side view of the upper insulation shell half of the insulation shell.
Figure 16:
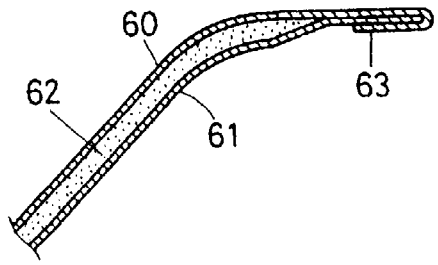
FIG. 16 is a partial longitudinal cross-sectional view of the upper insulation shell half of the insulation shell.
Figure 17:
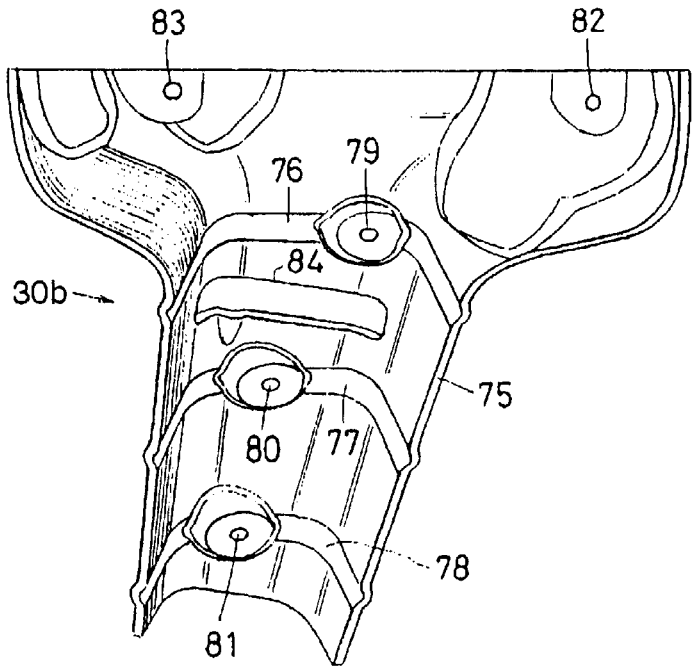
FIG. 17 is a plan view of an under insulation shell half of the insulation shell.
Figure 18:
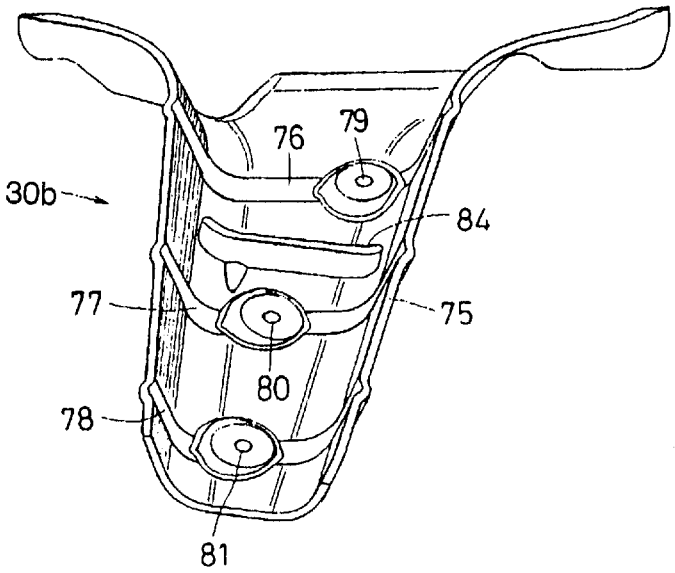
FIG. 18 is a front view of the under insulation shell half of the insulation shell.
Figure 19:
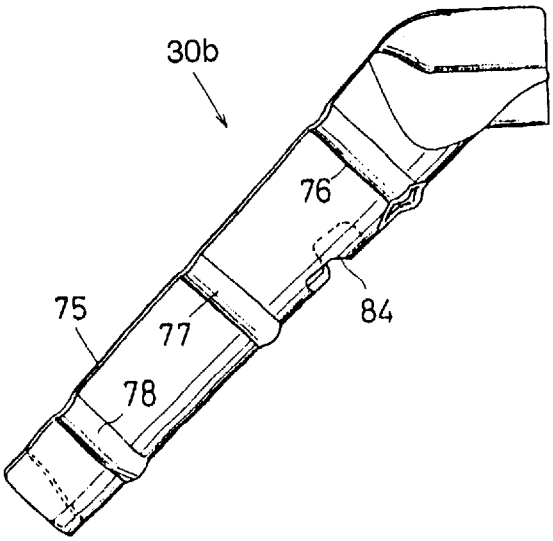
FIG. 19 is a side view of the under insulation shell half of the insulation shell.
Figure 20:
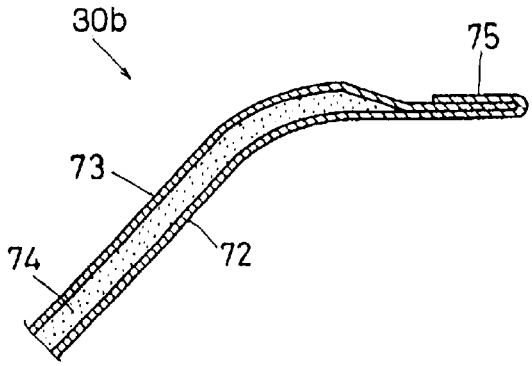
FIG. 20 is a partial longitudinal cross-sectional view of the under insulation shell half of the insulation shell.

FIG. 12 shows the spherical joint 29 in detail. The spherical joint 29 comprises a connecting pipe 53 that is fixedly attached to the lower end of the external pipe shell 35 of the collective chambered pipe 28, a substantially elliptical flange 54 welded, or otherwise fixedly attached, to the middle portion of the connecting pipe 53 and a joint 55 that is fixedly attached to the lower end of the connecting pipe 53. The joint 55 has a quadric surface 55*a* as a rolling guide surface. The spherical joint 29 includes a pair of connecting rods 56 with springs 59 mounted thereon. Each of the connecting rod 56 has a threaded head 56*a* and an annular shoulder 56*b* that are formed as spring retainer. The connecting rods 56 are fixedly attached to the elliptical flange 54 by fastening nuts 58 to the threaded heads 56*a* through washers 57, respectively. As shown also in FIG. 8, in connecting the exhaust pipe 19 to the spherical joint 29, after mounting the connecting rods 56 to an annular flange 19*b* of the exhaust pipe 19, the connecting rods 56 are fixedly attached to the elliptical flange 54 by fastening the nuts 58 so that a quadric surface 19*a* formed as a raceway of the annular flange 19*b* of the exhaust pipe 19 is remained in contact with the quadric rolling guide surface 55*a* by the springs 59. By connecting the exhaust pipe 19 to the collective chambered pipe 28 through the spherical joint 29 thus structured, the collective chambered pipe 28 is prevented from receiving adverse influence of rolling vibrations of the engine 11.

FIGS. 13 through 16 show a configuration of the upper insulation shell half 30*a* forming part of the insulation shell 30. The upper insulation shell half 30*a* that has a T-shaped external configuration and a gate-shaped cross section covers the entire upper half section of the exhaust line from the fitting flange 23 of the exhaust manifold 18 to the downstream end of the collective chambered pipe 28. As clearly shown in FIG. 16, the upper insulation shell half 30*a* comprises external and internal metal members 60 and 61 made of, for example, aluminum-plated metal plates and a heat insulation and sound absorption member 62 put between the external and internal wall metal members 60 and 61. The upper insulation shell half 30*a* is entirely hemmed around by a folded flange 63. As clearly shown in FIG. 13, the upper insulation shell half 30*a* having a T-shaped external configuration is formed as integral parts a plurality of projected ribs or beads 64–66 in a portion covering the collective chambered pipe 28. Each of the beads 64–66 extends in a transverse direction perpendicular to a direction of exhaust gas flow between opposite sides of the upper insulation shell half 30*a*. The upper insulation shell half 30*a* at the beads 64–66 are formed with bolt holes 67–69, respectively, for receiving fastening bolts for securing the upper insulation shell half 30*a* to the exhaust manifold 18. Further, the upper insulation shell half 30*a* at a portion covering the upstream end portions of the single-shell discrete exhaust pipes 24–27 is formed with bolt holes 70 and 71 for receiving fastening bolts for securing the upper insulation shell half 30*a* to the exhaust manifold 18. One of the two bolt holes 70 and 71, namely the bolt hole 71 in this embodiment, is formed in the shape of oval in consideration of easy positional adjustment and installation relative to the exhaust manifold 18 and allowing thermal expansion of the upper insulation shell half 30*a*.

FIGS. 17 through 20 show a configuration of the under insulation shell half 30*b* forming part of the insulation shell 30. Similarly to the upper insulation shell half 30*a*, the under insulation shell half 30*b* that has a T-shaped external configuration and a gate-shaped cross section covers the entire under half section of the exhaust line from the fitting flange 23 of the exhaust manifold 18 to the downstream end of the collective chambered pipe 28. As clearly shown in FIG. 20, the under insulation shell half 30*b* comprises external and internal wall metal members 72 and 73 made of, for example, aluminum-plated metal plates and a heat insulation and sound absorption member 62 put between the outer and inner wall metal members 60 and 61. The under insulation shell half 30*b* is entirely hemmed around by a folded flange 65. As clearly shown in FIG. 17, the under insulation shell half 30*b* having a T-shaped external configuration is formed as integral parts a plurality of projected beads or ribs 76–78 in a portion covering the collective chambered pipe 28. Each of the beads 64–66 extends in a transverse direction perpendicular to a direction of exhaust gas flow between opposite sides of the under insulation shell half 30*b*. The under insulation shell half 30*b* are formed at the beads 76–78 with bolt holes 79–81, respectively, and formed at a portion covering the upstream end portions of the single-shell discrete exhaust pipes 24–27 with bolt holes 82 and 83 for receiving fastening bolts for securing the under insulation shell half 30*b* to the exhaust manifold 18. One of the two bolt holes 82 and 83, namely the bolt hole 83 in this embodiment, is formed in the shape of oval in consideration of easy positional adjustment and installation relative to the exhaust manifold 18 and allowing thermal expansion of the under insulation shell half 30*b*. Further, the under insulation shell half 30*b* is formed with an aperture 84 between the beads 76 and 77 for allowing the supporting bracket 43 welded to the collective chambered pipe 28 to passes and extends to the bracket 45 fixedly attached to the cylinder block 12.

The beads 64–66 of the upper insulation shell half 30*a* and the beads 76–78 of the under insulation shell half 30*b* form mating halves of three beads entirely surrounding the insulation shell 30 and serve as a reinforcement.

Referring back to FIG. 6, the fitting flange 23 of the exhaust manifold 18 is provided with two brackets secured thereto, namely a front bracket 85 disposed between the first and second single-shell discrete exhaust pipes 24 and 25 and a rear bracket 86 disposed between the third and fourth single-shell discrete exhaust pipes 26 and 27. The front bracket 85 has upper and under fitting tongues 85*a* and 85*b*. Similarly, the rear bracket 86 has upper and under fitting tongues 86*a* and 86*b*.

The insulation shell 30 is installed to the exhaust manifold 18 by bolting the upper and under insulation shell halves 30*a* and 30*b* separately to the exhaust line. Specifically, the upper insulation shell half 30*a* is bolted to the upper fitting tongues 85*a* and 86*a* of the brackets 85 and 86 secured to the fitting flange 23 through the bolt holes 70 and 71 of the upper insulation shell half 30*a,* respectively, and to the brackets 46–48 (see FIG. 6) secured to the external pipe shell 35 of the collective chambered pipe 28 through the bolt holes 67–69, respectively. Similarly, the under insulation shell half 30*b* is bolted to the under fitting tongues 85*b* and 86*b* of the brackets 85 and 86 secured to the fitting flange 23 through the bolt holes 82 and 83 of the under insulation shell half 30*a,* respectively, and to the brackets 49–51 (see FIG. 7) secured to the external pipe shell 35 of the collective chambered pipe 28 through the bolt holes 70–81, respectively.

Figure 21:
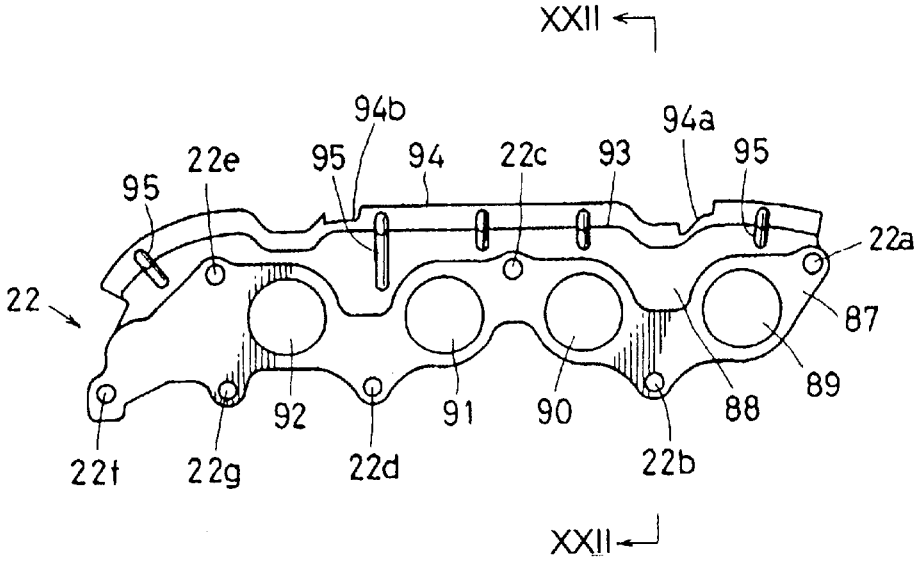
FIG. 21 is a front view of a gasket.
Figure 22:
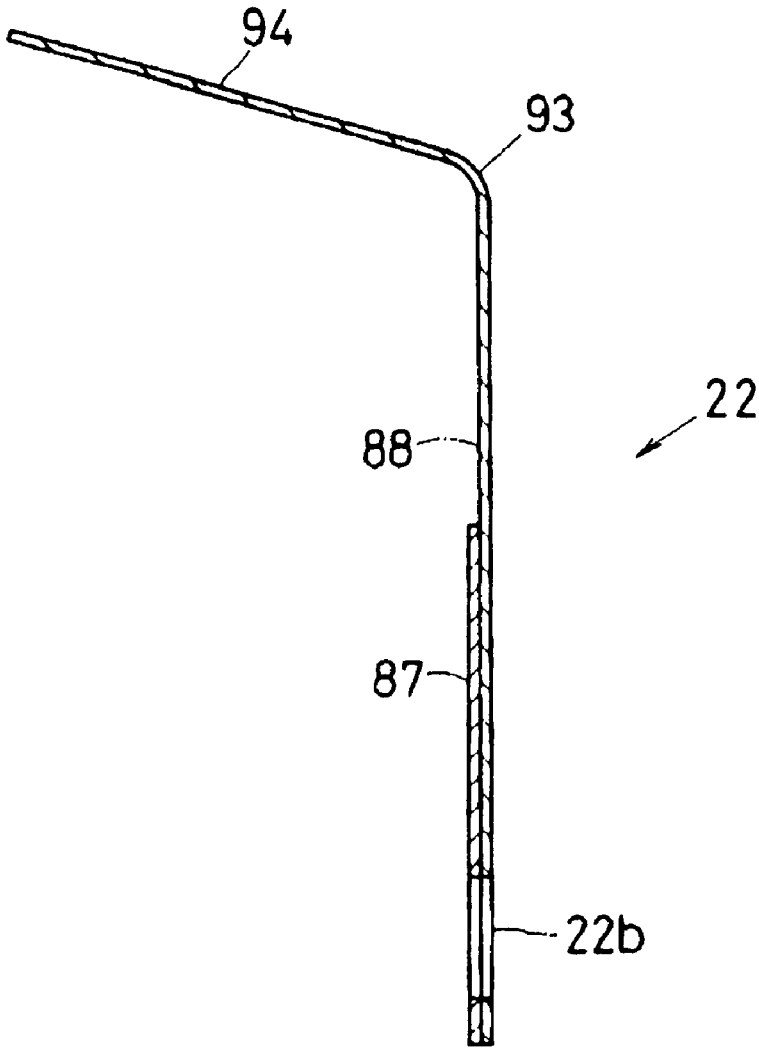
FIG. 22 is an enlarged cross-sectional view of the gasket taken along line XXII—XXII of FIG. 21.

FIGS. 21 and 22 show the gasket 22 through which the exhaust manifold 18 is installed to the cylinder head 13 of the engine 11. The gasket 22 comprises a first gasket member 87 desirably formed from a stainless steel plate and a second gasket member 88 desirably formed from a steel plate. The first gasket member 87 is attached to under portion of the second gasket member 88. The gasket 22 id formed with four apertures 89–92 corresponding in position to exhaust ports of the engine 11 in communication with the first to fourth cylinders (#144), respectively, and a plurality of bolt holes 22*a*–22*g* corresponding in position to the bolt holes 23*a*–23*g* (see FIG. 6) formed in the fitting flange 23 of the exhaust manifold 18. The upper portion of the second gasket member 88 extending beyond above the first gasket member 87 is bent back toward the exhaust manifold 18 so as to form a canopy fin 94 operative as a heat guide member to conduct and release exhaust heat therethrough. The canopy fin 94 extending toward the exhaust manifold 18 from the bend line 93. The gasket 22 is formed with a plurality of reinforcing beads 95 arranged at specified locations between the canopy fin 94 and the middle portion of the second gasket 88 that is not backed by the first-gasket member 87. Further, the second gasket member 88 at its upper edge of the canopy fin 94 is formed with recesses 94*a* and 94*b* engageable with the under fitting tongues 85*a* and 86*a* of the front and rear brackets 85 and 86. The canopy fin 94 operates as a heat guide member to conduct and release exhaust heat from between the exhaust manifold 18 and the insulation shell 30 toward far from the engine 11.

The gasket 22 thus structured prevents a rubber seal (not shown) for the gasket disposed between the cylinder head 13 and the head cover 14 and supplementary devices disposed around the engine 11 from encountering thermal deterioration.

In this instance, as shown in FIG. 2, the upper and under insulation shell halves 30*a* and 30*b* are adapted so that they are joined partly overlapping each other with a specified depth β along lengthwise sides. The joint gap of the overlapped sides of the upper and under insulation shell halves 30*a* and 30*b* is made as small as possible and desirably zero. Further, the upper and under insulation shell halves 30*a* and 30*b* are configured so as to provide a heat radiating space 31 having a specified distance L between the insulation shell 30 and the fitting flange 23 when the insulation shell 30 has been installed to the exhaust manifold 18. This configuration of the insulation shell 30 that provides the heat radiating space 31 is advantageous to releasing exhaust heat from the heat radiating space 31 provided between the fitting flange 23 and the insulation shell 30 and causing the canopy fin 94 to conduct and release exhaust heat from the heat radiating space 31 toward far from the engine 11. The space distance L is made greater than the joint gap between the overlapped sides β of the upper and under insulation shell halves 30*a* and 30*b* so as thereby to prevent exhaust heat from escaping from the insulation shell 30 through the joint gap but to radiate the exhaust heat to the exterior through the heat radiating space 31 between the insulation shell 30 and the fitting flange 23. In other words, the insulation shell 30 has a heat emission-resistance greater at the heat radiating space 31 than at the joint gap.

According to the exhaust system shown by way of example and described in detail with reference to FIG. 1 through 22, the exhaust manifold 18 of the exhaust system for an automobile engine comprises a plurality of single-shell discrete exhaust pipes 24–27 connected to exhaust ports formed in the cylinder head 13, respectively, the collective chambered pipe 28 joined to the single-shell discrete exhaust pipes 24–27 that is made up of an internal pipe shell 34 into which exhaust gas streams passing through the single-shell discrete exhaust pipes 24–27 are introduced and merge together and an external pipe shell 35 surrounding the internal pipe shell 34, and the spherical joint 29 connecting the collective chambered pipe 28 to the exhaust pipe 19 disposed downstream the collective chambered pipe 28 and supported to the vehicle body so as to allow relative movement between said exhaust manifold and said exhaust pipe. Each of the single-shell discrete exhaust pipes 24–27 has a bent portion 32 and a straight portion 33 continuously extending from the bent portion 32 to the collective chambered pipe 28. The bent portions of the single-shell discrete exhaust pipes 24–27 are bent toward a center of a straight row of cylinders so as to lay the straight portions of the single-shell discrete exhaust pipes nearly parallel to one another, and the single-shell discrete exhaust pipes 24–27 and the collective exhaust pipe 28 are joined to each other at least partly at a height of a plane including the interface 17*a* between the cylinder block 12 and the cylinder head 13.

The exhaust manifold 18 thus structured can be provided with a long straight path of exhaust gas by the straight portions 33 of the single-shell discrete exhaust pipes 24–27 and the collective chambered pipe 28 that is straight, so as thereby to reduce the resistance of exhaust gas and, as a result, help the engine to raise output. In addition, the collective chambered pipe 28 can be provided with high heat insulation effectiveness by having a length as long as possible. This results in quick activation of the catalytic converter installed in the exhaust system. The discrete exhaust pipe 24–27 that is made of a single shell is easily bent.

The spherical joint 29 between the collective chambered pipe 28 and the exhaust pipe 19 allows relative movement between the exhaust manifold and the exhaust pipe. This eases undesirable transmission of rolling vibrations of the engine 11 to the exhaust pipe 19 through the exhaust manifold 18.

The engine 11 is positioned so as to draw in intake air at the front side thereof and to discharge exhaust gases at the rear side thereof. Owing to this engine position, the exhaust manifold 18 is protected from exposure to the wind of speeding vehicle. This improves the high heat insulation effectiveness of the intake manifold 18. In addition, this makes it possible to shorten the length of the exhaust path from the upstream ends of the single-shell discrete exhaust pipes 24–27 to the catalytic converter 21.

The exhaust manifold 18 is provided with the fitting flange 23 connected to the upstream ends of the single-shell discrete exhaust pipes 24–27. The bolt holes 23*a*–23*g* formed in the fitting flange 23 are arranged alternately along opposite upper and under sides of the fitting flange in a direction of the straight row of cylinders. At least one of the bolt holes 23*a*–23*g* that is in close proximity to the single-shell discrete exhaust pipes, specifically the bolt hole 23*c* in close proximity to the single-shell discrete exhaust pipes 25 and 26, is located above a horizontal plane including centers of openings of the upstream ends of the single-shell discrete exhaust pipes 24–27. This arrangement of the bolt holes 23*a*–23*g* provides the straight portion 33 of each of the single-shell discrete exhaust pipes 24–27 with a long path of exhaust gas a sufficient space for installation work using, for example, an impact wrench. In this connection, if the bolt hole 23*c* in close proximity to the single-shell discrete exhaust pipes 25 and 26 is located below horizontal plane including centers of openings of the upstream ends of the single-shell discrete exhaust pipes 24–27, the bent portions 32 of the single-shell discrete exhaust pipes 24–27 must be long in consideration of a space for installation work using an impact wrench and the straight portions 33 of the single-shell discrete exhaust pipes 24–27 must be correspondingly shortened.

The exhaust manifold 18 includes the catalytic converter 21 disposed downstream from the collective chambered pipe 28 and under the vehicle body in close proximity to the collective chambered pipe 28. This arrangement of the catalytic converter 21 can get rid of the necessity of installing a catalytic converter immediately after an exhaust manifold like an exhaust system of a front exhaust engine and, as a result, can be located as close to the collective chambered pipe 28 as possible so as to be quickly activated due to a hot exhaust gas.

The interior of the collective chambered pipe 28 is divided into two collective chambers, the first collective chamber 41 and a second collective chamber 42 located closer to the engine than the first collective chamber 41, by the partition 36. Exhaust gas streams passing through the single-shell discrete exhaust pipes 24 and 27, respectively, for the cylinders at opposite ends of the straight row of cylinders enter into the first collective chamber and merge together. Exhaust gas streams passing through the single-shell discrete exhaust pipes 25 and 26 for the remaining cylinders enter into the second collective chamber 42 and merge together. The internal pipe shell 34 of the collective chambered pipe shell 34 extends straight in a direction of exhaust gas streams and gradually decreases in a cross-sectional area from the upstream end to the downstream end.

The collective chambered pipe 28 having the second collective chamber 42 located closer to the first collective chamber 41 makes it possible to employ the single-shell discrete exhaust pipes 24–27 that have the bent portions 32 shortened in length. The use of the partition 36 installed in the internal chambered pipe shell 34 makes the collective chambered pipe 28 compact as compared with using two independent internal pipe shells for dividing the interior of the collective chambered pipe 28 into the first and second collective chambers 41 and 42 and makes a surface area of the collective chambered pipe 28 small. This structure of the collective chambered pipe 28 reduces a thermal capacity, and hence heat radiation effectiveness, of the collective chambered pipe 28 and, in addition, gradually constricts an exhaust gas stream. In the case of installing the exhaust system to, in particular, a four-cylinder engine, a compact 4-2-1 type exhaust system, that is hardly affected by back pressure and exhaust gas pulsations, can be realized.

The exhaust manifold 18 further comprises the insulation shell 30 made up of two mating shell halves, i.e. the upper insulation shell half 30*a* and the under insulation shell half 30*b*, that covers the exhaust manifold 18, in particular at least the single-shell discrete exhaust pipes 24–27 that are apt to radiate a comparatively large amount of heat as compared with the double-shell collective chambered pipe 18. This prevents the exhaust manifold 18 from releasing heat to the atmosphere and, therefore, protects peripheral devices and parts from heat damage. Further, this provides the exhaust manifold 18 with high heat insulation effectiveness.

The spacer means 52 that is installed in a cylindrical space between the internal and external pipe shells 34 and 35 of the double-shell collective chambered pipe 28 separates the internal pipe shell 34 from the external pipe shell 35 mechanically so as to allow longitudinal expansion of the internal pipe shell 34 due to a difference of thermal expansion between the internal and external pipe shells 34 and 35. Further, the spacer means 52 has supporting rigidity greater at a specified extent of its lower portion than at the remaining portion. The difference in supporting rigidity can be realized by differing at least at least one of material, width in the lengthwise direction, thickness, and mesh size for the lower portion from that for the remaining portion.

The exhaust manifold 18 in which the spacer means 52 is installed in a cylindrical space in the collective chambered pipe 28 prevents the internal pipe shell 34, in particular the lower portion of the internal pipe shell 34, from causing mechanical interference with the external pipe shell 35 due to vibrations.

The exhaust manifold 18, that is structured suitably for the in-line four cylinder engine 11, comprises the four discrete exhaust pipes 24–27 connected to the cylinder head 13 and the collective chambered pipe 28 that is provided with the partition 36 and is connected to the downstream ends of the respective discrete exhaust pipes 24–27. The partition 36 divides the interior of the collective chambered pipe 28 into two collective chambers, the first collective chamber 41 into which exhaust gas streams passing through the discrete exhaust pipes 24 and 27 for the first and fourth cylinders at opposite extreme ends of the straight row of cylinders that do not sequentially adjoin in firing order and the second collective chamber 42 into which exhaust gas streams passing through the discrete exhaust pipes 25 and 26 for the second and third cylinders that do not sequentially adjoin in firing order. The partition 36 is installed in the collective chambered pipe 28 so as to position the first collective chamber 41 farther away from the engine 11 than the second collective chamber 42. The partition 36 at its top end is fixedly attached to the joined discrete exhaust pipes 24–27 at the welded joint structure 28*a* between the collective chambered pipe 28 and the discrete exhaust pipes 24–27 that has high structural rigidity. In addition, the supporting bracket 43 for supporting the exhaust manifold to the engine 11 is fixedly attached to the collective chambered pipe 28 at or in close proximity to the welded joint structure 28*a* on the side of the second collective chamber 42. The exhaust manifold 18 thus structured provides improved structural rigidity. The supporting bracket 43 is fixedly attached to the collective chambered pipe 28 far away from the partition 36. This location of the supporting bracket 43 restrains transmission of vibrations of the engine 11 to the partition 36 and, as a result, prevents the partition 36 from casing noises due to vibrations.

The supporting bracket 43, that comprises the bracket arm 43*a* and the flange tongue 43*b* connected as one right-angle piece by the curved portion 43*c*, is fixedly attached to the collective chambered pipe 28 at or in close proximity to a welded joint structure 28*a* between the collective chambered pipe 28 and the single-shell discrete exhaust pipes 24–27 on the side of the second collective chamber 42 and extends toward the engine 11. The supporting bracket 43 having the curved portion 43*c* is helpful in easing thermal expansion of the exhaust manifold 18 and also in absorbing vibrations transmitted from the engine 11.

The supporting bracket 43 is fixedly attached to the external pipe shell 35 downstream from the weld zone α (see FIG. 9) where the internal and external pipe shells 34 and 35 forming the double-shell collective chambered pipe 28 are welded to each other at their upstream ends. Because the supporting bracket 43 is fixedly attached to the double-shell collective chambered pipe 28 at a position where there is provided a space having a specified radial distance between the internal and external pipe shells 34 and 35, the collective chambered pipe 28 is prevented from receiving adverse influence of vibrations of the engine 11. In addition, the double-shell collective chambered pipe 28 can be provided with high heat insulation effectiveness, so that the catalytic converter installed in the exhaust system is quick activated.

As shown in FIG. 10, the single-shell discrete exhaust pipes 24–27 have downstream end portions, respectively, each of which comprises a rounded shell portion 24*a*–27*a* formed so as to meet partly the inner wall of the internal pipe shell 34 of the collective chambered pipe 28 and a right-angle shell portion 27*b*–27*b* and are arranged so as to form the cruciform space 37 among the adjacent right-angle shell portions 24*b*–27*b*. The cruciform space 37 is filled up with a cruciform reinforcement 38 made up of an upper extension 36*a* of the partition 36 of the collective chambered pipe 28 and a reinforcement strip 38*a* and welded to the inner right-angle shell portions 24*b*–27*b*. The cruciform reinforcement 38 avoids a presence of a joint gap among the first to forth exhaust pipes 24–27. This structure increases weld strength of the welded joint structure 28*a*. Further, the partition 36 having the upper extension 36*a* forming part of the cruciform reinforcement 38 is welded to the internal pipe shell 34 of the collective chambered pipe 28. This structure increases structural rigidity of the welded joint structure 28*a*.

The insulation shell 30 is configured so as to cover the exhaust manifold 18 from the fitting flange 23 to the downstream end of the collective chambered pipe 28 and is made up of at least two mating shell halves, i.e. the upper insulation shell half 30*a* and the under insulation shell half 30*b*. The insulation shell 30 provides a heat radiating space having a specified distance L between the insulation shell 30 and the fitting flange 23 when installed to the exhaust manifold 18. Further, the heat guide member extending toward far from the engine 11 is provided so as to conduct and release exhaust heat from the radiating space. The insulation shell 30 covers almost completely the exhaust manifold 18 and provides high heat insulation effectiveness. Further, the heat guide member conducts and releases exhaust heat from the radiating space toward far away from the engine 11 so as thereby to prevent the heat from going toward supplementary devices disposed around the engine 11 and a sealing gasket between the cylinder head 13 and the cylinder cover 14. This structure keeps an exhaust gas passing through the exhaust manifold 18 as high as possible so as thereby to activate quickly the catalytic converter and prevents the supplementary devices and the sealing gasket supplementary devices from encountering thermal deterioration. The heat guide member is provided as an integral part of the gasket 22 disposed between the fitting flange 23 and the cylinder head 13. This is helpful in conducting heat toward far from the engine even with a simple structure and contributive to reducing the number of parts and simplifying installation work.

The insulation shell 30 that comprises a plurality of shell members and can accordingly be formed in comparatively complicated configuration. The insulation shell 30 thus structured is suitable to cover an exhaust manifold formed in comparatively complicated configuration and is easily installed to the exhaust manifold. The insulation shell 30 has the overlapped sides β of the upper and under insulation shell halves 30*a* and 30*b* having a join gap between the overlapped sides β made as small as possible. On the other hand, the space distance L between the fitting flange 23 and the cylinder head 13 is made greater than the joint gap between the overlapped sides β of the upper and under insulation shell halves 30*a* and 30*b*. Accordingly, an exhaust heat is prevented from escaping from the insulation shell 30 through the joint gap of the overlapped sides of the upper and under insulation shell halves 30*a* and 30*b* but is allowed to be radiated to the exterior through the heat radiating space 31. This enhances a heat radiating effect of the heat guide member.

The exhaust manifold 18 is suitably installed to a rear exhaust type in-line multiple cylinder engine having a straight row of cylinders arranged in a transverse direction. In this arrangement, the direction in which exhaust heat from the heat radiating space 31 is radiated through the heat guide member such (the canopy fin 94) is identical with the direction in which the wind of the speeding vehicle blows into the engine compartment. This results in protecting that the engine 11 and its associated supplementary devices from heat damage and prevents the engine compartment from being filled with heat. Further, the exhaust system 18, in particular the discrete exhaust pipes 24–27 and the collective chambered pipe 28, are prevented from being exposed to the wind of the speeding vehicle. This not only prevents the exhaust gas from lowering its temperature but makes the exhaust path from the engine 11 to the catalytic converter 21 shorter as compared with a front exhaust system.

The insulation shell 30 has a plurality of beads 64–66 and 76–78 arranged in the transverse direction as a reinforcement that are formed with bolt holes 67–69 and 79–81, respectively. This insulation shell 30 thus structured is improved in its own structural rigidity. In addition, the insulation shell 30 is installed to the exhaust manifold 10 with high fitting rigidity by fastening bolts into the bolt holes 67–69 and 79–81. The beads 64–66 and 76–78 also serves to absorb and ease thermal expansion of the insulation shell 30.

Figure 23:
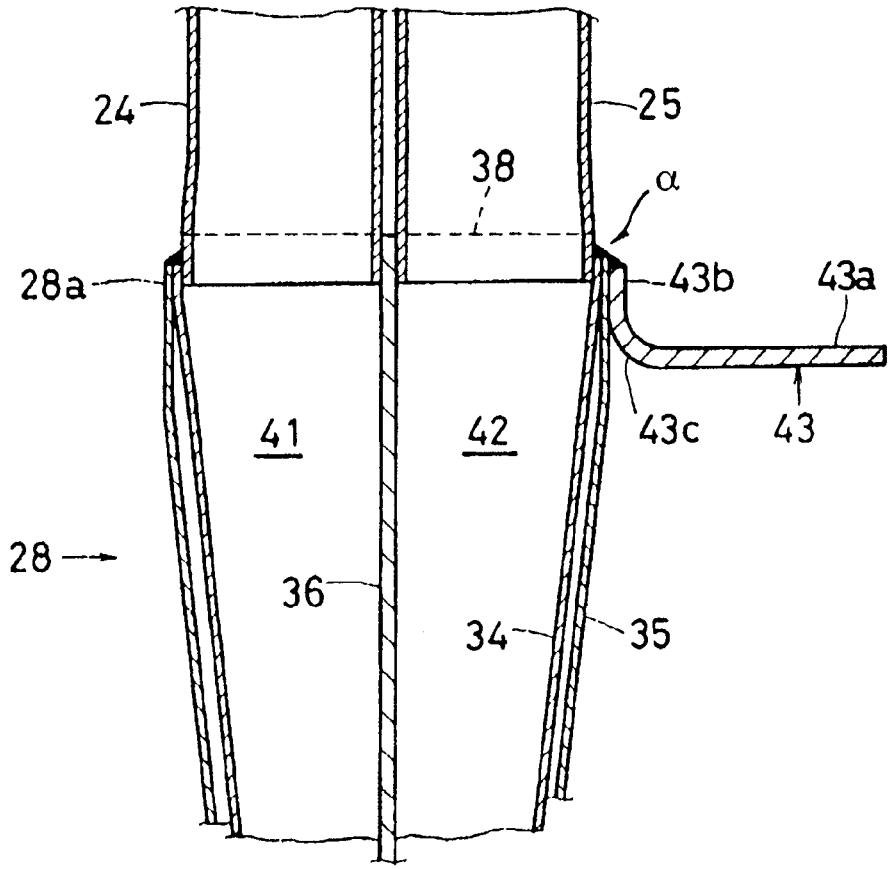
FIG. 23 is a longitudinal cross-sectional view of an exhaust manifold according to another embodiment of the present invention.

FIG. 23 shows part of an exhaust manifold 28 of the exhaust system according to another embodiment of the invention that is almost the same in structure and operation as that of the previous embodiment except a welded joint structure 28*a*. Specifically, a collective chambered pipe 28 into which exhaust gases are collectively introduced through single-shell discrete exhaust pipes 24–27 (single-shell discrete exhaust pipes 26 and 27 are hidden behind single-shell discrete exhaust pipes 24 and 25) is of a double-shell type. The collective chambered pipe 28, that is just the same in structure and operation as that of the previous embodiment, comprises an internal pipe shell 34 which an exhaust gas stream enters, an external pipe shell 35 surrounding the internal pipe shell 34 with an air space between the internal pipe shell 34 and a partition 36 that divides an upstream half portion of the interior of the collective chambered pipe 28 into two collective chambers, a first collective chamber 41 and a second collective chamber 42. These internal pipe shell 34 and external pipe shell 35 are welded at their upstream ends to each other.

The exhaust manifold 18 is provided with a supporting bracket 43 is welded, or otherwise fixedly attached, to the collective chambered pipe 28 downstream from the welded zone α, more particularly, at or in close proximity to a welded joint structure 28*a* between the collective chambered pipe 28 and the single-shell discrete exhaust pipes 24–27 on the side of the second collective chamber 42 and extending toward the engine 11. The supporting bracket 43 is fixedly connected to a bracket 45 secured to a cylinder block 12 of the engine 11 as shown in FIG. 1 by bolt and nut fastening means 44 (see FIG. 2). The supporting bracket 43 has a bracket arm 53*a* and a flange tongue 43*b* connected as one right-angle piece by a curved portion 43*c*. The flange tongue 43*b* is bent upward at an approximately right angle in this embodiment. The supporting bracket 43 at its upper end of the flange tongue 43*b* is welded to the upstream end of the external pipe shell 34.

According to this embodiment, the supporting bracket 43 is welded at a welded joint structure 28*a* at which the internal pipe shell 34, the external pipe shell 35 and the discrete exhaust pipes 25 and 26 are collectively joined, so that the weld strength at the welded joint structure 28*a* is improved and, in addition, the welding work is simplified as compared with the welded joint structure 28*a* of the exhaust manifold 28 of the previous embodiment shown in FIG. 9.

Figure 24:
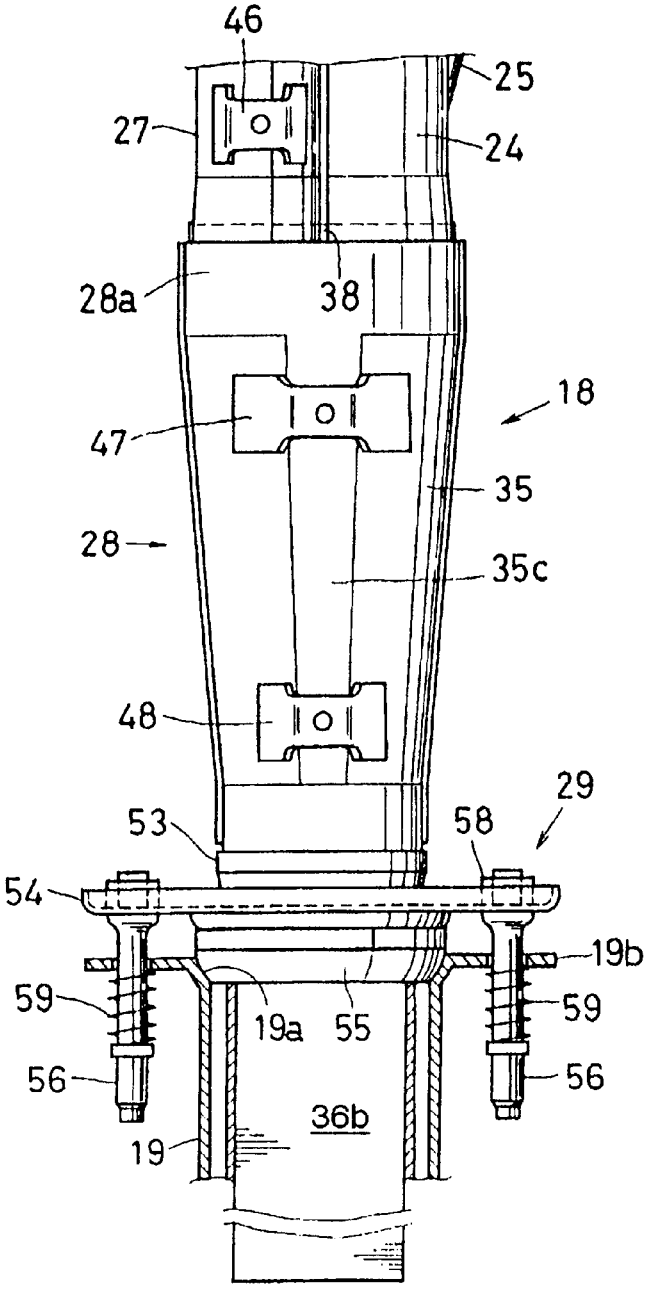
FIG. 24 is a front view, partly in cross-section, of a collective chambered pipe of an exhaust manifold according to another embodiment of the present invention.

FIG. 24 shows part of an exhaust manifold 28 of the exhaust system according to another embodiment of the invention that is almost the same in structure and operation as that of the previous embodiment, except a partition 36 that is installed in a collective chambered pipe 28 in order to divide the interior of the collective chambered pipe 28 into two collective chambers, namely a first collective chamber 41 and a second collective chamber 42. The partition 36 has a lower extension 36*b* extending into the interior of the exhaust pipe 19. The lower extension 36*b* may be provided as an independent additional partition separately from the partition 36. In this case, the independent partition member is installed in the exhaust pipe 19 with a clearance between the partition 36 that is appropriate for the independent additional partition to prevent the independent additional partition from causing mechanical interference with the partition 36 due to relative movement between the collective chambered pipe 18 and the exhaust pipe 19 and from having no adverse effect on the exhaust gas flow. The exhaust manifold 28 provided with the partition 36 having the lower extension 36*b* into the interior of the exhaust pipe 19 can form the 4-2-1 type exhaust system so as to make the two-channel part of exhaust path long.

Figure 25:
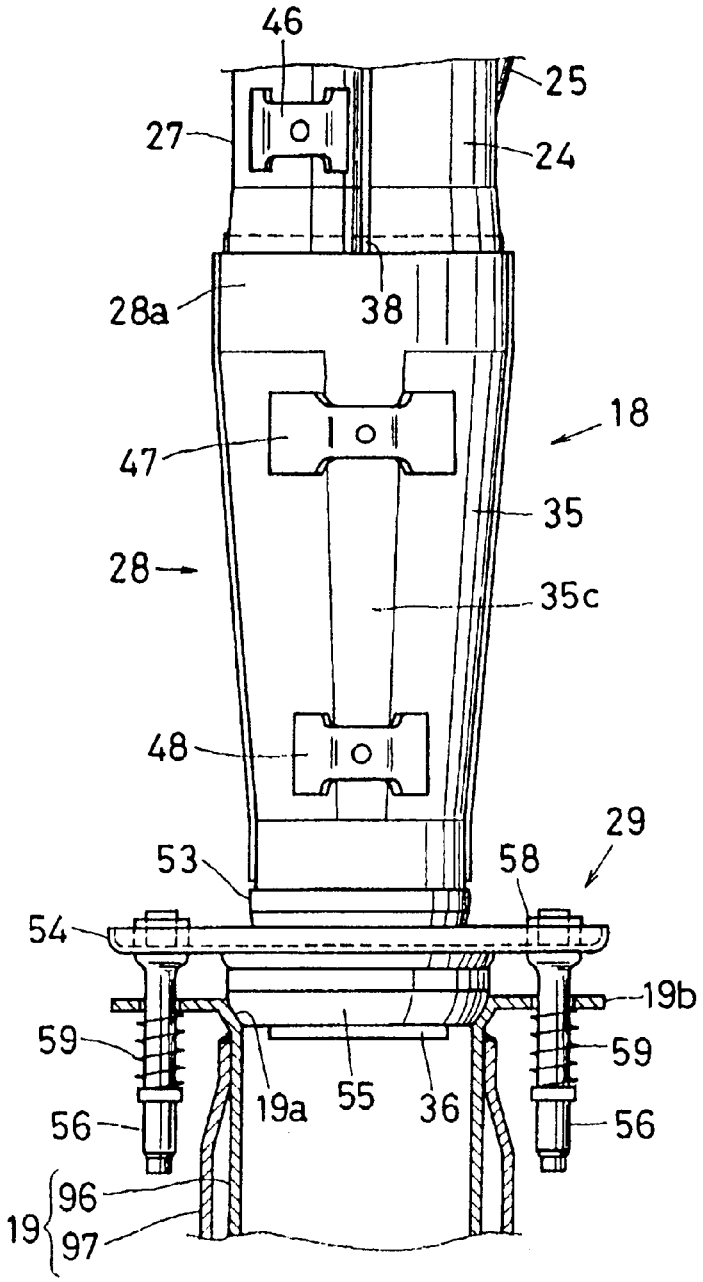
FIG. 25 is a front view, partly in cross-section, of an collective chambered pipe of an exhaust manifold according to still another embodiment of the present invention.

FIG. 25 shows part of an exhaust manifold 28 of the exhaust system according to still another embodiment of the invention that is almost the same in structure and operation as that of the previous embodiment, except an exhaust pipe 19. The exhaust pipe 19, that is of a double-shell type, comprises an internal pipe shell 96 through which an exhaust gas stream enters and an external pipe shell 97 surrounding the internal pipe shell 96 with an air space between the internal pipe shell 97. The exhaust system provided with the double-shell exhaust pipe 19 in addition to the collective chambered pipe 28 has improved high heat insulation effectiveness.

Figure 26:
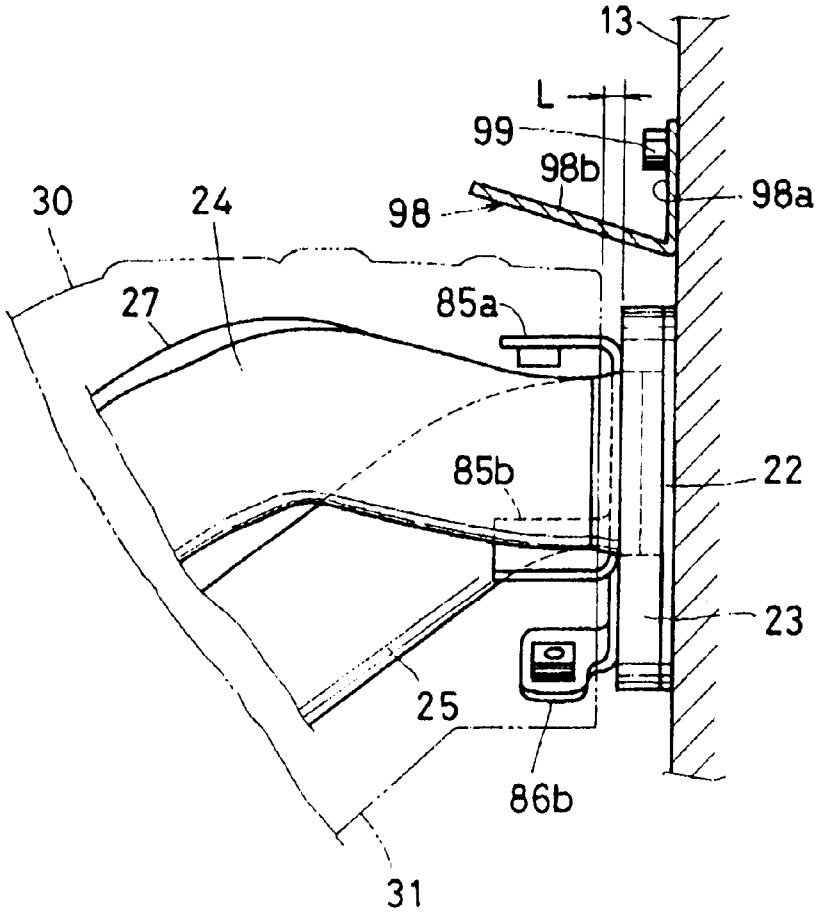
FIG. 26 is a partial side view of an exhaust manifold according to another embodiment of the present invention.

FIG. 26 shows part of an exhaust manifold 28 of the exhaust system according to a further embodiment of the invention that is almost the same in structure and operation as those of the previous embodiment, except a gasket 22 through which the exhaust manifold 18 is installed to a cylinder head 13 of the engine 11. The gasket 23 is different from those of the previous embodiment in that the gasket 23 has no canopy fin as a heat guide member. Specifically, the gasket 22 comprises a first gasket member and a second gasket member that however has no upper portion beyond above the first gasket member. In this embodiment, a heat guide member 98 is similar to the canopy fin 94 of the previous embodiment and is however formed separately from the gasket 22. The heat guide member 98 comprises a mounting portion 98*a* through which the heat guide member 98 is fixedly mounted to the cylinder head 13 by means of bolts 99 and a heat guide portion 98*b* that is bent forward up so as to conduct and guide exhaust heat from the heat radiating space between the exhaust manifold 18 and the insulation shell 30 toward far from the engine 11. This heat guide member 98 prevents a rubber seal (not shown) for the gasket disposed between the cylinder head 13 and the head cover 14 and supplementary devices disposed around the engine 11 from encountering thermal deterioration.

As described above, according to the exhaust system of the present invention, the exhaust manifold helps the engine to raise output due to a long straight path of exhaust gas that is provided by the straight portions 33 of the single-shell discrete exhaust pipes 24–27 and the collective chambered pipe 28 that is straight. In addition, the exhaust manifold provides improvement of heat insulation effectiveness by making the double-shell collective chambered pipe as long as possible. The discrete exhaust pipe that is of a single shell type makes bending work quite easy.

According to the structure of the exhaust manifold in which the partition is welded to the joint between the discrete exhaust pipes and the collective chambered pipe and the supporting bracket is welded to the collective chambered pipe 28 at or in close proximity to the joint that has a high structural rigidity, the exhaust manifold is provided with an improved high structural rigidity. Further, since these partition and supporting bracket are separately located as far away from each other as possible, the partition is prevented from receiving vibrations of the engine and, accordingly, from producing noises resulting from vibrations.

Further, according to the structure of the exhaust manifold in which there are provided the heat radiating space between the insulation shell and the fitting flange sufficient to radiate exhaust heat and the heat guide member extending toward far from the engine operative to conduct exhaust heat radiated from the heat radiating space toward far from the engine. This structure of the exhaust manifold prevents the gasket disposed between the cylinder head and the head cover and supplementary devices disposed around the engine from encountering thermal deterioration.

The present invention has been described with reference to preferred embodiments thereof. However, it will be appreciated that variants and other embodiments can be effected by person of ordinary skill in the art without departing from the scope of the invention.

What is claimed is:

1. A structure of exhaust system for an in-line multiple cylinder engine having a cylinder block and a cylinder head to be mounted on a vehicle body, which comprises an exhaust manifold connected to said cylinder head and an exhaust pipe supported to said vehicle body and connected to said exhaust manifold, said exhaust manifold comprising:

a plurality of single-shell discrete exhaust pipes that are connected to exhaust ports formed in said cylinder head, respectively;

a double-shell collective chambered pipe joined to said single-shell discrete exhaust pipes, said collective chambered pipe comprising an internal pipe shell into which exhaust gas streams passing through said single-shell discrete exhaust pipes are introduced and merge together and an external pipe shell surrounding said internal pipe shell with a cylindrical space left between said internal pipe shell; and a spherical joint connecting said collective chambered pipe to said exhaust pipe so as to allow relative movement between said exhaust manifold and said exhaust pipe;

a fitting flange connected to upstream ends of said single-shell discrete exhaust pipes through which said exhaust manifold is fixedly attached to said cylinder head;

a heat guide member extending toward far from said in-line multiple cylinder engine so as to conduct and release exhaust heat from said space toward far from said in-line multiple cylinder engine; and a heat insulation shell made up of upper and lower mating shell halves for covering said exhaust manifold comprising at least single-shell discrete exhaust pipes and said collective chambered pipe, each said shell half being connected to at least one of said single-shell discrete exhaust pipes and said collective chambered pipe with a specified distance of space provided between said fitting flange of said discrete exhaust pipes and an upstream end of said heat insulation shell;

wherein each said single-shell discrete exhaust pipe a bent portion extending from said exhaust port and a straight portion continuously extending from said bent portion to said collective chambered pipe, said bent portions of said single-shell discrete exhaust pipes being bent toward a center of a straight row of cylinders so as to lay said straight portions of said single-shell discrete exhaust pipes nearly parallel to one another and said single-shell discrete exhaust pipes and said collective exhaust pipe are at least partly joined to each other at a height of an interface between said cylinder block and said cylinder head.

2. An exhaust system for an in-line multiple cylinder as defined in claim 1, wherein said in-line multiple cylinder engine has a straight row of cylinders arranged in a transverse direction of said vehicle body and is disposed so as to draw intake air at a front side thereof and to discharge exhaust gases at a rear side thereof.

3. An exhaust system for an in-line multiple cylinder as defined in claim 1, wherein said fitting flange has a plurality of bolt holes through which bolts are fastened to said cylinder head so as thereby to fixedly attach said exhaust manifold to said cylinder head, said bolt holes being arranged alternately along opposite upper and under sides of said fitting flange in a direction of said straight row of cylinders and at least one of said bolt holes being located in close proximity to said single-shell discrete exhaust pipes and above a horizontal plane including centers of openings of said upstream ends of said single-shell discrete exhaust pipes.

4. An exhaust system for an in-line multiple cylinder as defined in claim 1, and further comprising a catalytic converter disposed downstream from said collective chambered pipe and under said vehicle body in close proximity to said collective chambered pipe.

5. An exhaust system for an in-line multiple cylinder as defined in claim 1, wherein said exhaust pipe comprises an internal pipe shell through which said exhaust gas stream passing through said collective chambered pipe passes and an external pipe shell surrounding said internal pipe shell.

6. An exhaust system for an in-line multiple cylinder as defined in claim 1, wherein said collective chambered pipe further comprises an internal partition that divides an interior of said internal pipe shell into two collective chambers, a first collective chamber into which said exhaust gas streams passing through said single-shell discrete exhaust pipes for said cylinders at opposite ends of said straight row of cylinders enter and a second collective chamber, located closer to said in-line multiple cylinder engine than said first collective chamber, into which said exhaust gas streams passing through said single-shell discrete exhaust pipes for remaining said cylinders enter, and said internal pipe shell extends straight in a direction of said exhaust gas streams and gradually decreases in a cross-sectional area from an upstream to downstream.

7. An exhaust system for an in-line multiple cylinder as defined in claim 6, and further comprising a bracket fixedly attached to said exhaust manifold at least at least near a joint between said single-shell discrete exhaust pipes and said collective chambered pipe at a side of said second collective chamber.

8. An exhaust system for an in-line multiple cylinder as defined in claim 1, and further comprising spacer means arranged in said cylindrical space so as to support said internal pipe shell to said external pipe shell with a specified separation, said spacer means having supporting rigidity higher at a lower portion of said cylindrical space than at the remainder of said cylindrical space.

9. An exhaust system for an in-line multiple cylinder as defined in claim 1, and further comprising a gasket disposed between said cylinder head and said exhaust manifold, said gasket being formed with said heat guide member as an integral part of said gasket.

10. A structure of exhaust system for an in-line multiple cylinder engine of a type having a cylinder block and a cylinder head to be mounted on a vehicle body such that a straight row of cylinders are arranged in a transverse direction of said vehicle body so as to draw intake air at a front side thereof and to discharge exhaust gases at a rear side thereof, which comprises an exhaust manifold connected to said cylinder head and an exhaust pipe supported to said vehicle body and connected to said exhaust manifold, said exhaust manifold comprising:

a plurality of single-shell discrete exhaust pipes that are connected to exhaust ports formed in said cylinder head, respectively;

a double shell collective chambered pipe joined to said single-shell discrete exhaust pipes, said collective chambered pipe comprising an internal pipe shell into which exhaust gas streams passing through said single-shell discrete exhaust pipes are introduced and merge together and an external pipe shell surrounding said internal pipe shell with a cylindrical space left between said internal pipe shell;

a spherical joint connecting said collective chambered pipe to said exhaust pipe so as to allow relative movement between said exhaust manifold and said exhaust pipe;

a fitting flange connected to upstream ends of said single-shell discrete exhaust pipes through which said exhaust manifold is fixedly attached to said cylinder head;

a heat insulation shell made up of upper and lower mating shell halves for covering said exhaust manifold comprising at least said single shell discrete exhaust pipes and said collective chambered pipe, each said shell half being connected to at least one of said single-shell discrete exhaust pipes and said collective chambered pipe with a specified distance of space provided between said fitting flange of said discrete exhaust pipes and an upstream end of said heat insulation shell; and a gasket disposed between said cylinder head and said exhaust manifold, said gasket being formed with said heat guide member as an integral part of said gasket; and wherein each said single-shell discrete exhaust pipe has a bent portion extending from said exhaust port and a straight portion continuously extending from said bent portion to said collective chambered pipe, said bent portions of said single-shell discrete exhaust pipes being bent toward a center of a straight row of cylinders so as to lay said straight portions of said single-shell discrete exhaust pipes nearly parallel to one another, and said single-shell discrete exhaust pipes and said collective exhaust pipe are at least partly joined to each other at a height of an interface between said cylinder block and said cylinder head.

11. An exhaust system for an in-line multiple cylinder as defined in claim 10, wherein said fitting flange has a plurality of bolt holes through which bolts are fastened to said cylinder head so as thereby to fixedly attach said exhaust manifold to said cylinder head, said bolt holes being arranged alternately along opposite upper and under sides of said fitting flange in a direction of said straight row of cylinders and at least one of said bolt holes being located in close proximity to said single-shell discrete exhaust pipes and above a horizontal plane including centers of openings of said upstream ends of said single-shell discrete exhaust pipes.

12. An exhaust system for an in-line multiple cylinder as defined in claim 10, and further comprising spacer means arranged in said cylindrical space so as to support said internal pipe shell to said external pipe shell with a specified separation, said spacer means having supporting rigidity higher at a lower portion of said cylindrical space than at the remainder of said cylindrical space.

* * * * *